US005155531A

United States Patent [19]

Kurotori et al.

[11] Patent Number: 5,155,531

[45] Date of Patent: Oct. 13, 1992

[54] APPARATUS FOR DECOMPOSING OZONE BY USING A SOLVENT MIST

[75] Inventors: Tsuneo Kurotori, Tokyo; Manabu Mochizuki, Yokohama; Ichiro Tsuruoka, Tokyo; Katsuhiro Echigo, Yokohama; Itsuo Ikeda, Sagamihara; Minoru Iwamoto, Yokohama; Hiroshi Tanabe, Kawasaki; Mayumi Miyao, Tokyo, all of Japan

[73] Assignee: Ricoh Company, Ltd., Tokyo, Japan

[21] Appl. No.: 589,075

[22] Filed: Sep. 27, 1990

[30] Foreign Application Priority Data

| | | | |
|---|---|---|---|
| Sep. 29, 1989 | [JP] | Japan | 1-254840 |
| Sep. 29, 1989 | [JP] | Japan | 1-254841 |
| Sep. 29, 1989 | [JP] | Japan | 1-254842 |
| Sep. 29, 1989 | [JP] | Japan | 1-254843 |
| Sep. 29, 1989 | [JP] | Japan | 1-254844 |
| Nov. 1, 1989 | [JP] | Japan | 1-285621 |
| Nov. 1, 1989 | [JP] | Japan | 1-285622 |
| Nov. 30, 1989 | [JP] | Japan | 1-311712 |

[51] Int. Cl.[5] ..... G03G 21/00

[52] U.S. Cl. ..... 355/215; 355/282

[58] Field of Search ..... 355/30, 215, 256, 282, 355/284, 204, 200, 285; 350/582; 219/216; 346/159

[56] References Cited

U.S. PATENT DOCUMENTS

| | | | |
|---|---|---|---|
| 3,854,224 | 12/1974 | Yamaji et al. | 355/256 X |
| 3,914,046 | 10/1975 | Tanaka et al. | 355/30 X |
| 4,178,092 | 12/1979 | Yamamoto et al. | 355/200 |
| 4,401,385 | 8/1983 | Katayama et al. | 355/299 |
| 4,540,268 | 9/1985 | Toyono et al. | 355/210 |
| 4,549,803 | 10/1985 | Ohno et al. | 219/216 X |
| 4,607,936 | 8/1986 | Miyakawa et al. | 219/216 X |
| 4,805,001 | 2/1989 | Hayashi et al. | 355/58 |
| 4,853,735 | 8/1989 | Kodama et al. | 355/215 |

FOREIGN PATENT DOCUMENTS

| | | | |
|---|---|---|---|
| 0080238 | 7/1978 | Japan | 355/215 |
| 0109484 | 5/1988 | Japan | 355/215 |

*Primary Examiner*—A. T. Grimley
*Assistant Examiner*—William J. Royer
*Attorney, Agent, or Firm*—Cooper & Dunham

[57] ABSTRACT

An image formation apparatus including a latent electrostatic image formation unit for forming on a latent-electrostatic-image-bearable photoconductive member a latent electrostatic image corresponding to an original image; a development unit for developing the latent electrostatic image into a visible toner image with a developer; an image-transfer unit for transferring the visible toner image from the photoconductive member to a transfer sheet; an image-fixing unit for fixing the visible toner image to the transfer sheet, including an image fixing roller, the surface of which is coated with a release agent comprising a silicone oil; a solvent mist generation unit for generating a solvent mist; and an ozone decomposing unit for trapping and decomposing ozone generated in the image formation apparatus by mixing the ozone with the solvent mist.

17 Claims, 15 Drawing Sheets

APPARATUS FOR DECOMPOSING OZONE BY USING A SOLVENT MIST

BACKGROUND OF THE INVENTION

1. Field of the Invention

The present invention relates to an image formation apparatus in which a latent electrostatic image is formed on an electrophotographic photoconductor or an electrostatic recording member by an electrostatic recording method, and in particular to an image formation apparatus comprising a means for decomposing ozone generated in the apparatus by intentionally bringing ozone into contact with a mist of, for example, a carrier liquid for a liquid developer, and a release agent applied to a heat-application roller in an image fixing unit.

2. Discussion of Background

In an image formation apparatus employing an electrostatic recording method, namely, an electrostatic copying apparatus, a latent electrostatic image is formed on an electrophotographic photoconductor or an electrostatic recording member. The latent electrostatic image is developed into a visible toner image with a wet- or dry-type developer and the toner image thus obtained is electrostatically transferred to a transfer sheet and fixed thereto by using a heat-application roller. Thus, the toner image can be fixed to the transfer sheet.

FIG. 1 shows a conventional dry-type electrophotographic copying apparatus. In FIG. 1, a photoconductive drum 3 is rotatably driven in the clockwise direction. An original (not shown) is placed on a contact glass 1, with an image-bearing side thereof in contact with the contact glass 1. The surface of the photoconductive drum 3 is uniformly charged by an electric charger 10 and exposed to the light images which are converted from the original images of the original by an optical scanning system 2. As a result, the latent electrostatic images corresponding to the original images are formed on the surface of the photoconductive drum 3. The latent electrostatic images are developed to visible toner images with a dry-type developer in a development unit 12. The visible toner images thus formed on the photo-conductive drum 3 are transferred via a transfer charger 14 to a transfer sheet which is supplied from a paper supply cassette 4 or 5. The transfer sheet is separated from the photoconductive drum 3 using a separation charger 15 and transported to an image fixing unit through a conveyor belt 19. In the image fixing unit, the toner images transferred on the transfer sheet are thermally fixed thereto by causing the sheet to pass between a pair of image fixing rollers 20. After the completion of the image fixing, the transfer sheet is discharged onto a copy tray 22.

In FIG. 1, reference numerals 6 and 7 indicate paper supply rollers; reference numeral 8, a resist roller; reference numeral 9, paper carrier roller; reference numeral 11, an eraser; reference numeral 13, a quenching lamp for image transfer; reference numeral 16, a separation pawl; reference numeral 17, a fur brush; reference numeral 18, a quenching lamp; reference numeral 21, a pair of paper discharging rollers; reference numeral 30, a toner concentration detector; and reference numeral 31, a slit.

As mentioned above, the photoconductor or electrostatic recording member is charged to a predetermined polarity by a corona charger in the course of the latent electrostatic image formation process, and the toner images formed on the photoconductor or electrostatic recording member are transferred to the transfer sheet using the corona charger. This results in the generation of ozone in the apparatus. In addition to the corona charger, a quenching unit is provided in order to constantly produce high quality images in a high-speed image formation apparatus or an image formation apparatus applicable to the wide-width image formation. When the quenching unit is in operation, electrical discharging takes place and ozone is generated by the electrical discharging. Thus, the quenching unit is also a source of generating ozone. Accordingly, ozone is unfavorably generated and built-up in the image formation apparatus during the operation thereof.

When the concentration of the ozone reaches 0.02 ppm or more, some people feel a foreign odor. At a concentration of 0.1 ppm or more, the ozone gives an unpleasant feeling and it cannot be ignored from the viewpoint of hygiene.

In addition to the above, when the inside of the image formation apparatus is exposed to the ozone at a concentration of 0.1 ppm or more for an extended period of time, the constituent parts of the image formation apparatus such as a rubber member deteriorate, and the characteristics of a photoconductive layer of the photoconductor are degraded because of oxidation caused by the ozone.

To remove the ozone generated in the image formation apparatus, an ozone decomposing unit employing an ozone decomposing agent is conventionally proposed. However, the ozone decomposing unit makes it difficult to reduce the size of the image formation apparatus. Furthermore, when such an ozone decomposing unit is employed, the ozone decomposing agent has to be replenished and the maintenance of the ozone decomposing unit is necessary, which increases the cost of the image formation apparatus as a whole.

When a wet-type electrophotographic copying apparatus is compared with a dry-type electrophotographic copying apparatus, the amount of ozone discharged from the wet-type copying apparatus is smaller. This is possibly because a solvent used as a carrier liquid for a liquid developer vaporizes in a development unit to become a mist. During the development of latent electrostatic images with a liquid developer and the transfer of the developed images after development, the carrier liquid for the liquid developer which has deposited on the photoconductive drum or the transfer sheet also vaporizes in the apparatus to become a mist. When the mist of the carrier liquid hanging in the apparatus comes into contact with ozone generated in the image formation apparatus, part of the ozone is decomposed to oxygen. Furthermore, a release agent which is applied to a heated image-fixing roller vaporizes and turns into a mist during the thermal image fixing. When the solvent mist of the release agent comes into contact with ozone, the ozone is slightly decomposed.

In a dry-type electrophotographic copying apparatus, only a release agent can become a solvent mist, so that the amount of the solvent mist generated therefrom is small. Thus, ozone is hardly decomposed by the mist of the conventional release agent in the dry-type copying apparatus.

Conventionally, the decomposition of ozone depends on the degree of the spontaneous contact of the mist of a solvent, such as a carrier liquid for the liquid developer, with the ozone, both of which are merely in suspension in the air in the apparatus, and the solvent mist is not intentionally brought into contact with the ozone by use of a special means. Therefore, the ozone is hardly decomposed.

The liquid developer which is prepared by dispersing toner particles in an aliphatic hydrocarbon such as nonane, decane, isododecane and isooctane is conventionally used in the wet-type image formation apparatus. These aliphatic hydrocarbons are excellent in the image fixing performance, so that they are widely used as the carrier liquids for the liquid developer. However, the aliphatic hydrocarbons have particular odors and are readily oxidized to produce an offensive odor when heated in the image fixing operation.

As previously mentioned, a heat-application roller is generally employed in the image fixing unit of the image formation apparatus. A release agent, such as a silicone oil, is applied to the surface of the heat-application roller in order to easily separate a transfer sheet from the heat-application roller after the image fixing operation. The silicone oil used as the release agent vaporizes and becomes a solvent mist by the application of heat in the image fixing operation and goes up in a white smoke, which makes an unfavorable impression upon the users of this kind of image formation apparatus. Therefore, the silicone oil with a small volatile content, usually less than 0.5 wt. % is conventionally used.

To prepare a silicone oil with a small volatile content, however, a costly refining process is required. Furthermore, when the silicone oil is applied to the surface of the heat-application roller, a release agent application pad is generally used. Since the release agent application pad impregnated with the silicone oil is disposed in pressure contact with the surface of the heat-application roller, the silicone oil considerably evaporates and is wasted even when the image forming process is not carried out. It is desired that the silicone oil be not only effectively used as the release agent for the heat-application roller, but also efficiently utilized for decomposing the aforementioned ozone.

SUMMARY OF THE INVENTION

Accordingly, an object of the present invention is to provide an image formation apparatus free from the above-mentioned conventional shortcomings, in which ozone generated in the apparatus can be effectively decomposed without using a particular ozone decomposing agent.

The above-mentioned object of the present invention can be achieved by an image formation apparatus comprising (i) a latent electrostatic image formation means for forming on a latent-electrostatic-image-bearable photoconductive member a latent electrostatic image corresponding to an original image; (ii) a development means for developing the latent electrostatic image into a visible toner image with a developer; (iii) an image-transfer means for transferring the visible toner image from the photoconductive member to a transfer sheet; (iv) an image-fixing means for fixing the visible toner image to the transfer sheet, comprising a heat-application roller, the surface of which is coated with a release agent comprising a silicone oil; (v) a solvent mist generation means for generating a solvent mist; (vi) an ozone decomposing means for trapping and decomposing ozone generated in the image formation apparatus by mixing the trapped ozone with the solvent mist.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein:

FIG. 4(*b*) is an enlarged detailed view of an image fixing unit A and an ozone trapping and decomposing unit B in the dry-type electrophotographic copying apparatus of FIG. 3;

DESCRIPTION OF THE PREFERRED EMBODIMENTS

A wet-type electrophotographic copying apparatus, one example of the image formation apparatus according to the present invention, will now be explained in detail by referring to FIG. 2.

Figure 2:
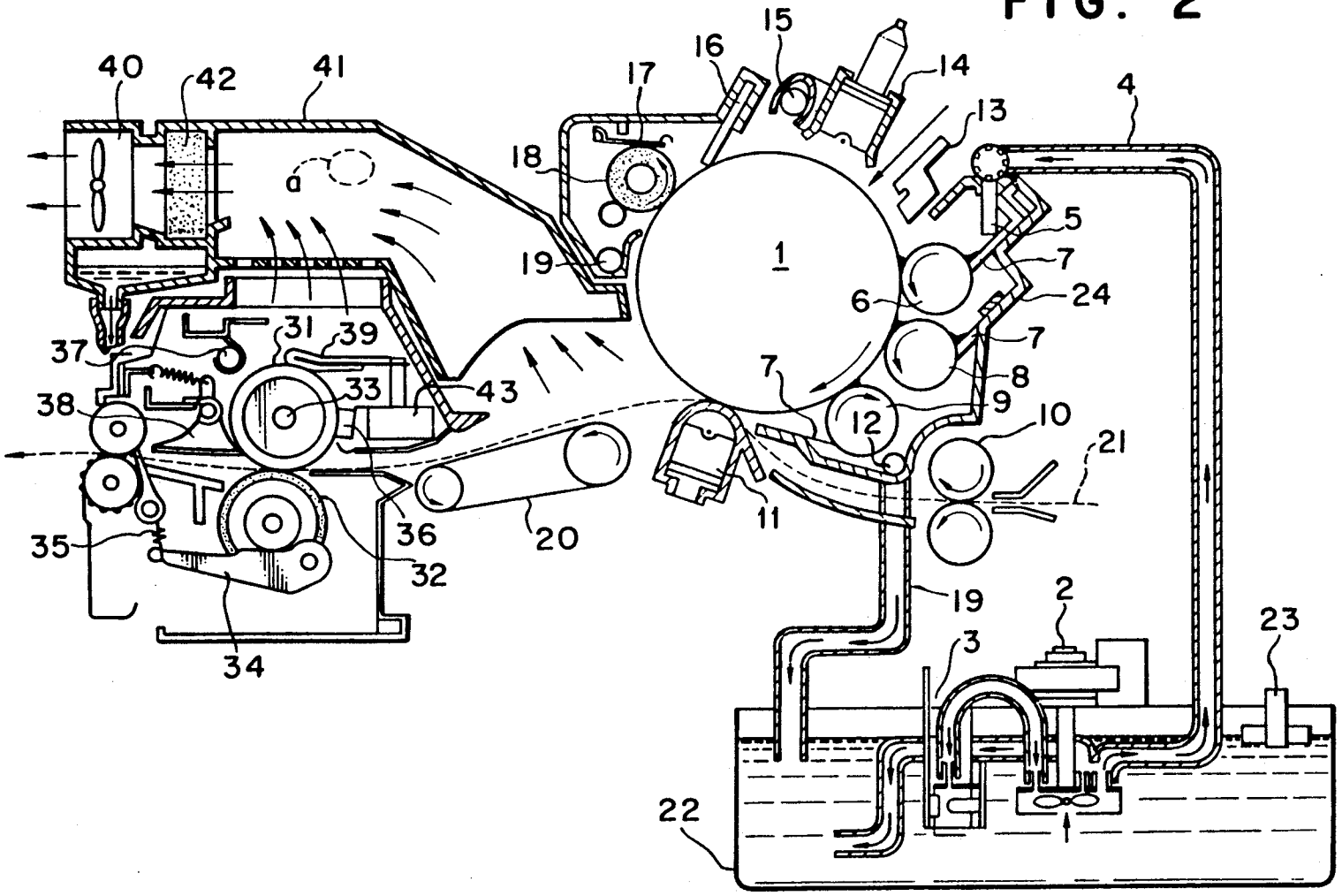
FIG. 2 is a schematic cross-sectional view of a wet-type electrophotographic copying apparatus, one example of the image formation apparatus according to the present invention.

In FIG. 2, a photoconductive drum 1 is rotatably driven in the direction of the arrow at a constant speed by a drive system (not shown) in the course of a copying operation. The outer surface of the photoconductive drum 1 is uniformly charged to a predetermined polarity by a main charger 14, and exposed to a light image which is converted from an original image by an exposure system. Thus, a latent electrostatic image is formed on the surface of the photoconductive drum 1. At the same time, the non-image-formation areas on the photoconductive drum 1 are quenched by an eraser 13.

The latent electrostatic image formed on the photoconductive drum 1 is developed to a visible toner image by a first development roller 6 and a second development roller 8 both of which support a liquid developer thereon. The development rollers 6 and 8 are rotatably driven in the direction of the arrow, with a slight gap being provided between the development rollers 6 and 8, and the photoconductive drum 1. The residual toner particles deposited on the development rollers 6 and 8 are cleared therefrom by the respective scrapers 7 which are fixed to a development container 24. In the development unit, a reverse squeeze roller 9 and a scraper 7 which is in contact with the reverse squeeze roller 9 are also provided in the development container 24. The reverse squeeze roller 9 is rotatably driven in the direction of the arrow by the drive system, and squeezes the excessive liquid developer deposited on the photoconductive drum 1. The liquid developer squeezed by the reverse squeeze roller 9 is scraped therefrom by the scraper 7 in contact therewith. The carrier liquid for the liquid developer for use in the present invention comprises a silicone oil.

The toner image thus developed on the photoconductive drum 1 is transferred via a transfer charger 11 to a transfer sheet 21 which is supplied from a paper supply unit (not shown) and carried by sheet-transport rollers 10 along a paper path as indicated by the broken-line.

The transfer sheet 21 which bears the toner image is separated from the surface of the photoconductive drum 1 by separation rollers (not shown) and led to an image fixing unit along a transfer-sheet conveyor belt 20.

In the image fixing unit, the transfer sheet 21 which bears the toner image is caused to pass between a heat-application roller 31 with a built-in heater 33 and a pressure-application roller 32. After the completion of the image fixing operation, the transfer sheet 21 is discharged from the electrophotographic copying apparatus.

After separation of the transfer sheet 21 from the photoconductive drum 1, the residual liquid developer on the photoconductive drum 1 is cleared therefrom by a cleaning foam roller 18 and a cleaning blade 16 of a cleaning unit. Reference numeral 17 indicates a liquid developer spreading plate and reference numeral 19, a liquid developer discharge hole. The residual electric charge of the photoconductive drum 1 is then quenched by a quenching lamp 15 (or a quenching charger) to be ready for the subsequent copying operation.

Prior to the image fixing operation, a set of squeeze rollers consisting of a blotter roller and a sponge roller may be provided to squeeze out a carrier liquid of the liquid developer which permeates through the transfer sheet.

In the image fixing unit, the toner image formed on the transfer sheet 21 is brought into contact with the surface of the heat-application roller 31. The heat-application roller 31 is brought into pressure contact with the pressure-application roller 32, with a path for the transfer sheet 21 provided therebetween. A pressure-application lever 34 is brought into pressure contact with a shaft portion of the pressure-application roller 32 by the force of a spring 35, whereby a predetermined pressure is applied to the pressure-application roller 32. Thus, a nip is formed between the heat-application roller 31 and the pressure-application roller 32. The heat-application roller 31 has a built-in heater 33 as a heat source for the image-fixing, as previously mentioned. The temperature of the built-in heater 33 is controlled by a thermistor 36 and a temperature fuse 37. A transfer-sheet separation pawl 38 and a release agent application felt 39 are provided in contact with the outer surface of the heat-application roller 31. Reference numeral 43 indicates a release agent reservoir which is connected to the above-mentioned release agent application felt 39.

The liquid developer stored in a liquid developer reservoir 22 of a developer supply unit is pumped by a pump 2, carried through a developer supply pipe 4 and supplied to the development unit via a developer supply nozzle 5 which is located at the upper part of the development unit. The unused liquid developer is collected and stored in the bottom of the development unit. It finally flows into a developer discharge hole 12 by gravity and returns through a developer recovery pipe 19 to the liquid developer reservoir 22 of the developer supply unit. Reference numerals 23 and 3 indicate a liquid developer level detection float sensor and a toner concentration detector, respectively.

In the present invention, a solvent mist generation means, an ozone and solvent mist trapping means and an ozone discharging means are provided in the copying apparatus. Therefore, ozone which is generated from the main charger 14 and the transfer charger 11 is effectively brought into contact with (i) the mist of the carrier liquid generating from the development rollers 6 and 8, the photoconductive drum 1, the transfer sheet 21, and the cleaning unit, and (ii) the mist of the release agent applied to the heat-application roller in the image fixing unit, so that the ozone is efficiently trapped and decomposed. Thereafter the above trapped ozone and solvent mist are discharged together from the apparatus by the ozone discharging means.

In FIG. 2, a duct 41 equipped with a suction fan 40 therein serves to trap the ozone, bring the ozone into contact with the solvent mist and then discharge them together. In this figure, the ozone and solvent mist are trapped together in the duct 41 by the suction of the suction fan 40. Alternatively, the ozone and the solvent mist may separately be trapped in the respective trapping means, and thereafter they may be mixed together to come in contact with each other. Reference numeral 42 indicates a silicone oil recovery filter. The ozone and the solvent mist generated in the apparatus are sucked in the direction of the arrow by the suction fan 40 and trapped in the duct 41, where they are mixed together and come in contact with each other effectively. As a result, the ozone is decomposed and the solvent mist is discharged from the apparatus.

In this case, the solvent mist comprises the mist of the carrier liquid for the liquid developer and the mist of the release agent applied to the heat-application roller. The carrier liquid for the liquid developer for use in the present invention comprises a silicone oil.

Conventionally, aliphatic hydrocarbons such as nonane, decane, isododecane and isooctane are used as the carrier liquids for the liquid developer. However, they have an odor and are apt to give off an offensive odor when oxidized by the application of heat in the image fixing performance. In contrast to this, the silicone oil has no odor, and is excellent in thermal stability, so that the generation of an offensive odor can considerably be decreased when used in combination with the aliphatic hydrocarbons. When the silicone oil is used alone as the carrier liquid for the liquid developer, as a matter of course, no offensive odor is generated.

Since the silicone oil recovery filter 42 is provided before the outlet of the duct 41, the solvent mist of the silicone oil is trapped thereby and recovered in the form of droplets of the silicone oil as gradually cooled. The droplets of the silicone oil are stored in a silicone oil reservoir which is disposed below the filter 42 and finally returned to the liquid developer reservoir 22. The silicon oil recovery filter 42 promotes the effectiveness of the contact of the ozone and the solvent mist because the silicone oil mist is trapped in the filter 42.

When the suction fan 40 is driven to rotate too fast, the thermal energy for the image fixing unit is wasted. The suction force of the suction fan 40 may be preferably determined so as not to disturb the image fixing operation. For the silicone oil recovery filter 42, a material with a small pressure loss is used.

The carrier liquid for the liquid developer for use in the present invention comprises a liquid-type silicone oil with a siloxane structure. For example, a dimethyl silicone, a methylphenyl silicone, a cyclic silicone (cyclic polysiloxane) and the mixture thereof can be used as the carrier liquid. The above-mentioned silicone oil can be used as the carrier liquid for the liquid developer in combination with a paraffin- or isoparaffin-based aliphatic hydrocarbon such as nonane, decane, isododecane, isooctane and ligroin. From the viewpoint of prevention of the generation of a foreign or offensive odor, as previously mentioned, the silicone oil with a siloxane structure is preferably used alone as the carrier liquid for the liquid developer.

The effect of the present invention will now be explained in detail by the following copying test.

EXAMPLES 1-1 TO 1-7 AND COMPARATIVE EXAMPLE 1-1

The liquid developer reservoir 22 of the wet-type electrophotographic copying apparatus as shown in FIG. 2 was supplied with the respective developers comprising the respective carrier liquids as shown in Table 1, and copying tests were carried out by continuously making copies for 8 hours (19,200 sheets) with a commercially available transfer sheet, "Type 6200" (A-4 size), made by Ricoh Company, Ltd., at a linear speed of 266 mm/sec and the image-fixing temperature of 140°±10° C.

Using the same wet-type electrophotographic copying apparatus in the above, the copying test was carried out without passing the transfer sheet.

After the completion of the copying operation, the concentration of ozone was measured by a commercially available CLD ozone analysis system "DY8410" (Trademark), made by Dylec Co., Ltd., and the odor was assessed by an organoleptic test. The test was carried out in a 30 $m^3$ room without ventilation at 23°±2° C. and 55±5% RH. The nozzle for measuring the ozone concentration was set inside the duct 41, 20 cm from the outlet thereof.

The results are given in Table 1.

TABLE 1

| | Passing of Transfer Sheet | Carrier Liquid | Ozone Concentration (ppm) | Odor * |
|---|---|---|---|---|
| Comp. Ex. 1 | Free run | — | 0.136 | 4 |
| Comp. Ex. 2 | Free run | Isoparaffin-based aliphatic hydrocarbon** | 0.082 | 4 |
| Ex. 1 | Free run | Methylphenyl silicone*** | 0.068 | 2 |
| Ex. 2 | Free run | Dimethyl silicone**** | 0.058 | 2 |
| Ex. 3 | Free run | KF-58/ Isopar H (50/50 vol. %) | 0.073 | 2~3 |
| Comp. Ex. 3 | Presence (sidewise) | — | 0.114 ****** | 3~4 |
| Comp. Ex. 4 | Presence (sidewise) | Isoparaffin-based aliphatic hydrocarbon** | 0.038 | 4 |
| Ex. 4 | Presence (sidewise) | Methylphenyl silicone*** | 0.032 | 0~1 |
| Ex. 5 | Presence (sidewise) | Dimethyl silicone**** | 0.023 | 0~1 |
| Ex. 6 | Presence (sidewise) | Cyclic polysiloxane***** | 0.024 | 0~1 |
| Ex. 7 | Presence (sidewise) | KF-58/ Isopar H (50/50 vol. %) | 0.033 | 2 |

*The odor was organoleptically assessed in the range of grade 0 to grade 5:
grade 0: no odor
grade 5: extremely strong odor.
grades 1 to 4: odors between the above grades
**"Isopar H" (Trademark), made by Exxon Chemical Japan, Ltd.
***"KF-58" (Trademark), made by Shin-Etsu Polymer Co., Ltd.
****"KF-96L-1" (Trademark), made by Shin-Etsu Polymer Co., Ltd.
*****"KF-994" (Trademark), made by Shin-Etsu Polymer Co., Ltd.
******When the transfer sheet was passed through the apparatus, the ozone concentration was decreased from 0.136 ppm to 0.114 ppm even though the carrier liquid solvent was not used. This was because the ozone was decomposed by coming into contact with a water component vaporizing from the transfer sheet.

As can be seen from the results in Table 1, the carrier liquid for the liquid developer for use in the present invention comprises a silicone oil with a siloxane structure and there is provided in the apparatus a means for effectively trapping the ozone and solvent mist to come in contact with each other and discharging them from the apparatus. Accordingly, the ozone can be effectively decomposed and the generation of an unpleasant odor can be remarkably decreased.

Figure 3:
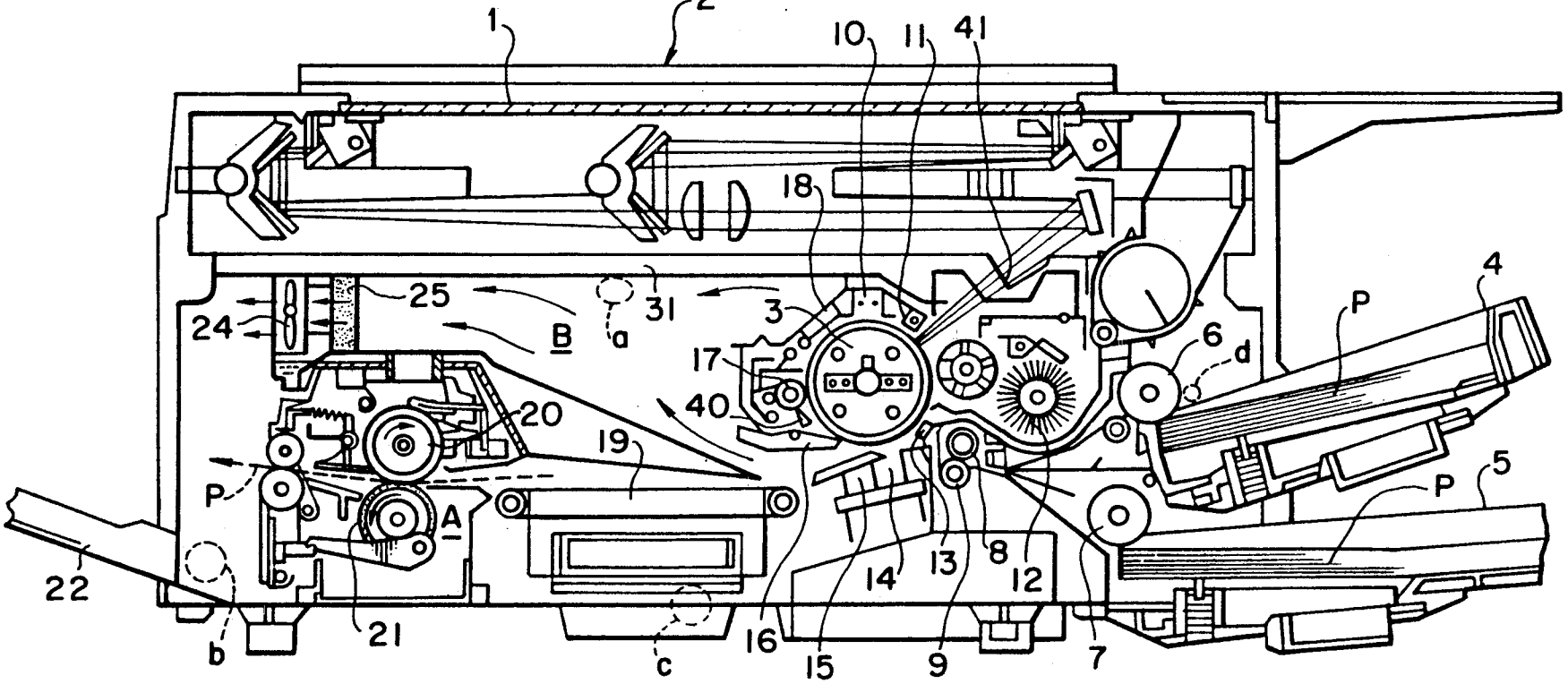
FIG. 3 is a schematic cross-sectional view of a dry-type electrophotographic copying apparatus, one example of the image formation apparatus according to the present invention.

FIG. 3 is a schematic cross-sectional view of a dry-type electrophotographic copying apparatus equipped with a photoconductive drum.

In FIG. 3, a photoconductive drum 3 is rotatably driven in the clockwise direction. The outer surface of the photoconductive drum 3 is uniformly charged to a predetermined polarity by a main charger 10. An original (not shown) is placed on a contact glass 1 with an image-bearing side thereof in contact with the contact glass 1, and the original image is read by an optical scanning system 2 and converted into a light image. The light image is projected onto the surface of the photoconductive drum 3, so that a latent electrostatic image is formed on the photoconductive drum 3. At the same time, the non-image-formation areas on the photoconductive drum 3 are quenched by an eraser 11.

The latent electrostatic image formed on the photoconductive drum 3 is developed into a visible toner image with a dry-type developer (toner) in a development unit 12.

A transfer sheet P is supplied from a paper supply cassette 4 or 5 through a set of rollers 8 and 9 synchronously with the formation of the visible toner image on the photoconductive drum 3, and is moved toward a transfer charger 14, overlapping the toner image developed on the photoconductive drum 3. The toner image on the photoconductive drum 3 is charged by the transfer charger 14 and transferred to the transfer sheet P.

The transfer sheet P which bears the toner image is separated from the photoconductive drum 3 by a separation charger 15 and a separation pawl 16, and then transported to an image fixing unit A along a transfer sheet conveyor belt 19.

In the image fixing unit A, the transfer sheet P which bears the toner image is caused to pass between a heat-application roller 20 and a pressure-application roller 21 as indicated by the broken-line. After the completion of the thermal image fixing performance, the transfer sheet P is discharged onto a paper discharge tray 22.

In FIG. 3, reference numerals 6 and 7 indicate paper supply rollers; reference numeral 13, a quenching lamp for image transfer; reference numeral 17, a fur brush; reference numeral 18, a quenching charger or quenching lamp; reference numeral 40, a toner concentration detector; and reference numeral 41, a slit.

The image fixing unit A will be explained in further detail.

Figure 4A:
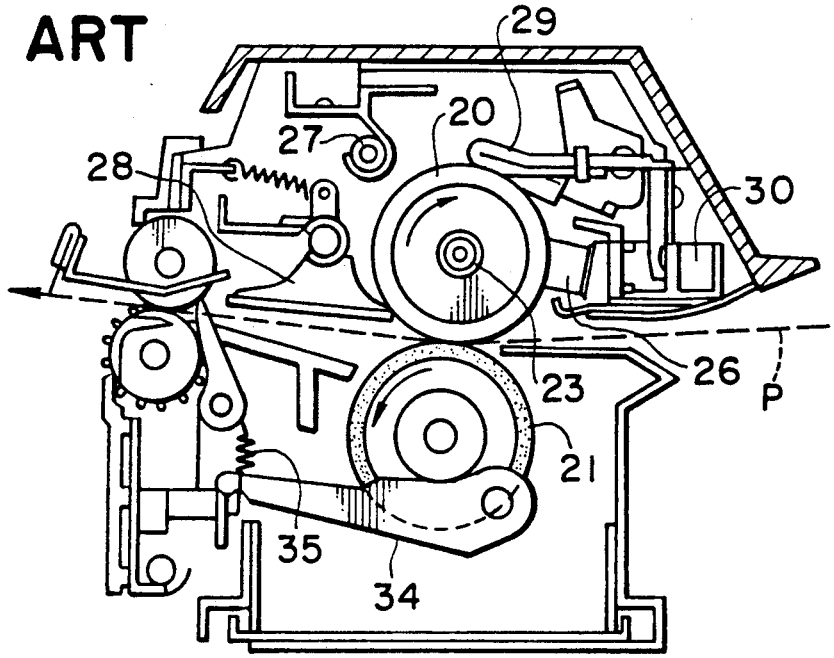
FIG. 4(a) PRIOR ART
FIG. 4(*a*) is an enlarged detailed view of a conventional image fixing unit in the dry-type copying apparatus.
Figure 4B:
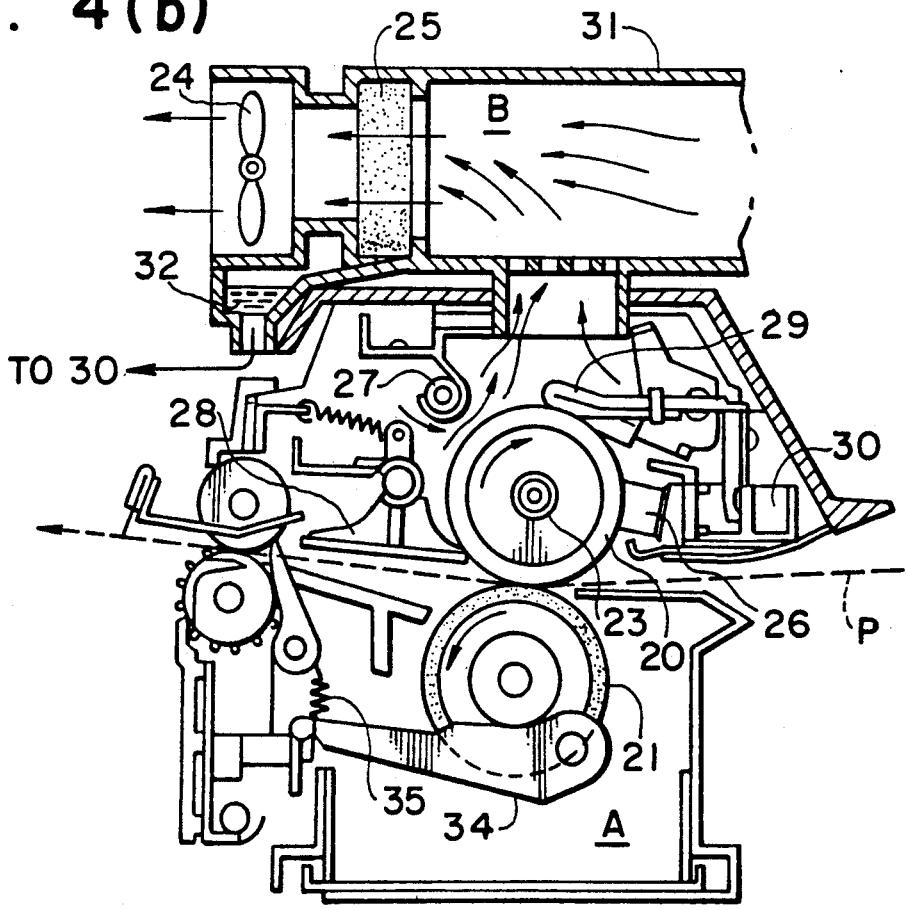

FIG. 4(*a*) is a conventional image fixing unit in the dry-type copying apparatus of FIG. 3. In contrast to this, as shown in FIG. 4(*b*), when a release agent (silicone oil) which is applied to the surface of the heat-application roller 20 vaporizes during the thermal image fixing, the mist of the release agent can be introduced into an ozone trapping and decomposing unit B from a vent which is provided at an upper part of an external cover of the image fixing unit A.

In the image fixing unit A in FIG. 4(*b*), the heat-application roller 20 with a built-in heater 23 is brought into pressure contact with the pressure-application roller 21, with a path for the transfer sheet P being provided therebetween. A pressure-application lever 34 is brought into pressure contact with a shaft portion of the pressure-application roller 21 by the force of a spring 35, whereby a predetermined pressure is applied to the pressure-application roller 21. A thermistor 26 and a temperature fuse 27 are provided around the heat-application roller 20, which serve to control the temperature of the heat-application roller 20 and prevent abnormal increase of the temperature of the built-in heater 23.

A transfer sheet separation pawl 28 and a release agent application felt 29 are provided in contact with the outer surface of the heat-application roller 20. A silicone oil in a release agent reservoir 30 is supplied to the release agent application felt 29.

Figure 18:
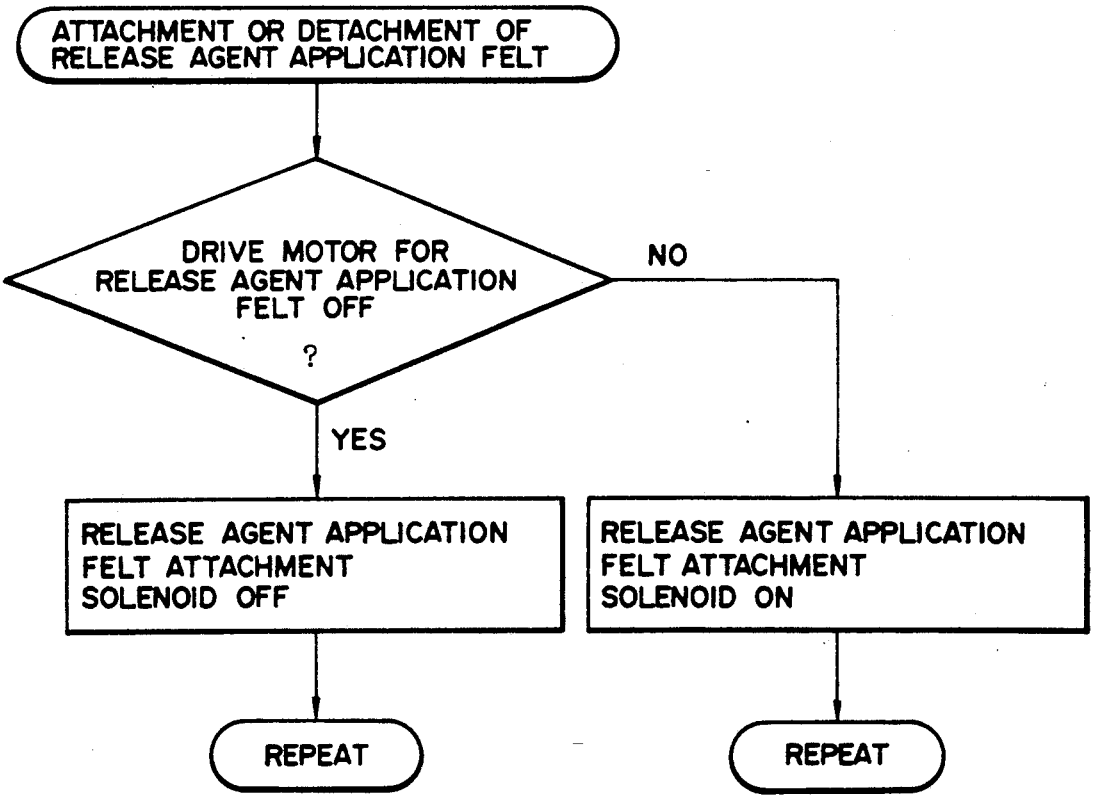
FIG. 18 is a flow chart of the control operation of a release agent application felt in the dry-type image formation apparatus according to the present invention.

Preferably, in the present invention, the release agent application felt 29 is designed in such a fashion that it may come into pressure contact with the outer surface of the heat-application roller 20 or it may be detached therefrom. Namely, the release agent application felt 29 can be detached from the surface of the heat-application roller while the copying apparatus is not in operation. As a result, the consumption of the release agent can be decreased. The detachment of the release agent application felt 29 from the heat-application roller 20 depending on the operation of the heat-application roller 20 may preferably be controlled by a control system. The flow chart of this operation is shown in FIG. 18.

As the temperature of the heat-application roller 20 increases in order to thermally fix the toner image to the transfer sheet P by passing the transfer sheet between the heat-application roller 20 and the pressure-application roller 21 in the image fixing unit A, the volatile components of the release agent comprising the silicone oil which is applied to the surface of the heat-application roller 20 evaporate and become a mist. At the same time, the water component contained in the transfer sheet P also evaporates and becomes a mist.

In the present invention, the mist of the release agent which comprises a silicone oil and the water component in the transfer sheet generate from the image fixing unit A and flow into the ozone trapping and decomposing unit B through the vent at the upper part of the cover of the image fixing unit A. This solvent mist comes into contact with ozone which is sucked into the ozone trapping and decomposing unit B, whereby the ozone is decomposed.

This ozone trapping and decomposing unit B, which is built in the dry-type electrophotographic copying apparatus of FIG. 3, comprises a duct 31, a suction fan 24 which is provided at the outlet of the duct 31 and a recovery filter 25. As in the case of the wet-type copying apparatus, the recovery filter 25 effectively promotes the contact of the mist of the release agent which is generated from the heat-application roller 20 with the ozone which is generated around the main charger 10, the transfer charger 14 and the quenching charger 18, because the mist of the release agent comprising the silicone oil adheres to the recovery filter 25. In addition, the silicone oil mist trapped by the recovery filter 25 becomes droplets as gradually cooled, so that the silicone oil can be recovered in the form of droplets in a release agent recovery tank 32 and then returned to the release agent reservoir 30 to be repeatedly used as the release agent for the heat-application roller.

As mentioned above, the suction force of the suction fan 24 may adequately be determined, with the heat loss in the image fixing performance taken into consideration. For the recovery filter 25, a material with a small pressure loss is used.

The release agent applied to the surface of the heat-application roller 20 comprises a liquid-type silicone oil with a siloxane structure. For example, a dimethyl silicone, a methylphenyl silicone, a cyclic silicone (cyclic polysiloxane) and the mixture thereof can be used. Of these, dimethyl silicone is preferable. Furthermore, it is preferable that the volatile components of the silicone oil used for the release agent be 0.5 wt. % or more, and more preferably 0.1 wt. % or more. This is because such silicone oils can be manufactured at low costs and it is easy to cause these silicone oils to become a mist.

Using the dry-type electrophotographic copying apparatus equipped with the image fixing unit A and the ozone trapping and decomposing unit B as shown in FIG. 4(*b*), a copy test was carried out as follows:

EXAMPLE 2-1

A dry-type developer (toner) was supplied to the dry-type electrophotographic copying apparatus of FIG. 3 and a commercially available dimethyl silicone, "KF-96" (Trademark), with the content of volatile components of 0.5 wt. % and a viscosity of 300 cs, made by Shin-Etsu Polymer Co., Ltd., serving as a release agent of a heat-application roller 20 was placed in a release agent reservoir 30 of the copying apparatus.

A copy test was carried out by continuously passing a commercially available transfer sheet, "Type 6200" (Trademark), made by Ricoh Company, Ltd., through the copying apparatus for 3 hours at a linear velocity of 345 mm/sec and the surface temperature of the heat-application roller 20 of 180°±20° C.

The concentration of the ozone contained in the gas discharged from the ozone trapping and decomposing unit B was measured by a commercially available CLD ozone analysis system, "DY8410" (Trademark), made by Dylec Co., Ltd.

The test was carried out in a 30 $m^3$ room without ventilation at 23°±2° C. and 55±5% RH. The nozzle for measuring the ozone concentration was set inside the duct 31, 20 cm from the outlet thereof.

After the completion of copy-making over a period of 3 hours, the ozone concentration was 0.036 ppm.

In addition, the hot off-set phenomenon did not occur until the surface temperature of the heat-application roller reached 240° C.

EXAMPLE 2-2

A copy test was carried out in the same manner as employed in Example 2-1 except that a commercially available dimethyl silicone, "KF-96-1" (Trademark), made by Shin-Etsu Polymer Co., Ltd., with the content of volatile components of 0.5 wt. % and a viscosity of 1 cs was added to the release agent used in Example 2-1 in an amount ratio of 1 wt. %.

After the completion of copy-making over a period of 3 hours, the ozone concentration was 0.029 ppm.

In addition, the hot off-set phenomenon did not occur until the surface temperature of the heat-application roller reached 250° C.

EXAMPLE 2-3

A copy test was carried out in the same manner as employed in Example 2-1 except that the surface temperature of the heat-application roller 20 was changed to 200°±20° C.

After the completion of copy-making over a period of 3 hours, the ozone concentration was 0.024 ppm.

When the surface temperature of the heat-application roller 20 exceeded 200° C., the amount of the mist of the release agent applied to the heat-application roller 20 abruptly increased. As a result, the mist of the release agent, which became a white smoke, passed through the recovery filter 25, without trapped thereby.

EXAMPLE 2-4

A copy test was carried out in the same manner as employed in Example 2-1 except that the release agent was changed to a commercially available methylphenyl silicone, "KF-56" (Trademark), made by Shin-Etsu Polymer Co., Ltd., with the content of volatile components of 0.5 wt. %.

After the completion of copy-making over a period of 3 hours, the ozone concentration was 0.042 ppm.

In addition, the hot off-set phenomenon occurred when the surface temperature of the heat-application roller reached 190° C.

COMPARATIVE EXAMPLE 2-1

A copy test was carried out in the same manner as employed in Example 2-1 except that the image fixing unit A employed in Example 2-1 was changed to the conventional one as shown in FIG. 4(*a*) without the ozone trapping and decomposing unit, and that the release agent was changed to a commercially available dimethyl silicone with the content of volatile components of 0.1 wt. % or less.

After the completion of copy-making over a period of 3 hours, the ozone concentration was as high as 0.173 ppm.

In addition, the hot off-set phenomenon occurred when the surface temperature of the heat-application roller reached 240° C.

As can be seen from the results of the copy tests, since the image formation apparatus according to the present invention comprises a means for trapping ozone and the mist of the release agent for the heat-application roller, ozone is caused to come into contact with the mist of the release agent effectively and is readily decomposed.

By providing a release agent recovery filter and a recovery tank, the silicone oil, which is superior in the thermal stability, invulnerable to oxidation, and has no odor, can be repeatedly used as the release agent.

To avoid the hot off-set phenomenon, dimethyl silicone is particularly desirable.

EXAMPLES 3-1 TO 3-3 AND COMPARATIVE EXAMPLE 3-1

The copying tests in Examples 2-1 to 2-3 and Comparative Example 2-1 were repeated except that each test was intermittently carried out with alternative one-hour operation and one-hour non-operation. The results were exactly the same as in Examples 2-1 to 2-3 and Comparative Example 2-1.

As previously mentioned, both in the wet- and dry-type electrophotographic copying apparatus, the ozone and the solvent mist are trapped together in an ozone trapping means, namely, a duct equipped with a suction fan. Alternatively, they may be separately trapped in the respective trapping means. Thereafter, they are mixed so as to be caused to come into contact with each other to decompose the ozone. Finally, they are discharged from the apparatus.

In the present invention, a control system may be provided to control the operation of the suction fan, for example, in accordance with the concentration of ozone built up in the apparatus or the number of copies made.

In the case where the operation of the suction fan is controlled by the control system in accordance with the ozone concentration, an ozone concentration detector is set in the apparatus. For example, in FIG. 3, the nozzle of the ozone concentration detector may preferably be set at the position "a", "b", "c" or "d". In the wet-type electrophotographic copying apparatus as shown in FIG. 2, an adequate position of the ozone concentration detector is the position "a" because it is considered that the average concentration of ozone in the apparatus can be measured at the position "a". The reason for this is that the position "a" is apart from the various chargers which are the generation sources of ozone. In the vicinity of the chargers, the on-and-off operation of the chargers induces large dispersion of the ozone concentration.

When the nozzles are placed at the positions "b", "c" and "d", the concentration of ozone contained in the gas which is finally discharged from the apparatus can be measured.

When the ozone concentration thus detected by the ozone concentration detector reaches a predetermined level, the suction fan 40 is driven to rotate by the control system. To the contrary, the rotation of the suction fan 40 is stopped when the ozone concentration decreases to a predetermined level. This control system can prevent the unnecessary rotation of the suction fan 40, thus saving energy. Since there is a difference in the sensitivity to the odor of ozone among individuals, the above-mentioned predetermined levels of the ozone concentration may freely be altered, using the read only memory (ROM) in the control system.

The above-mentioned embodiment will now be explained in detail by the following examples.

EXAMPLE 4-1

A liquid developer reservoir 22 of the wet-type electrophotographic copying apparatus as shown in FIG. 2 was supplied with a liquid developer which comprised a carrier liquid of a commercially available methylphenyl silicone, "KF-58" (Trademark), made by Shin-Etsu Polymer Co., Ltd.

An ozone concentration detector was set at the position "a" in the copying apparatus of FIG. 2. A program of the control system was made in such a fashion that a suction fan was driven to rotate when the concentration of ozone detected by the ozone concentration detector attained to 0.02 ppm, and that the rotation of the suction fan was stopped when the ozone concentration decreased to 0.01 ppm.

Using a commercially available transfer sheet, "Type-6200" (A-4 size), made by Ricoh Company, Ltd., a continuous copy test was performed at a linear velocity of 266 mm/sec and an image fixing temperature of 140°±10° C.

As a result of the continuous copy test, the ozone concentration was maintained in the range of 0.01 to 0.02 ppm, and there was no odor of ozone.

As previously mentioned, the operation of the suction fan may be controlled by the control system in accordance with the number of copies made.

Figure 6:
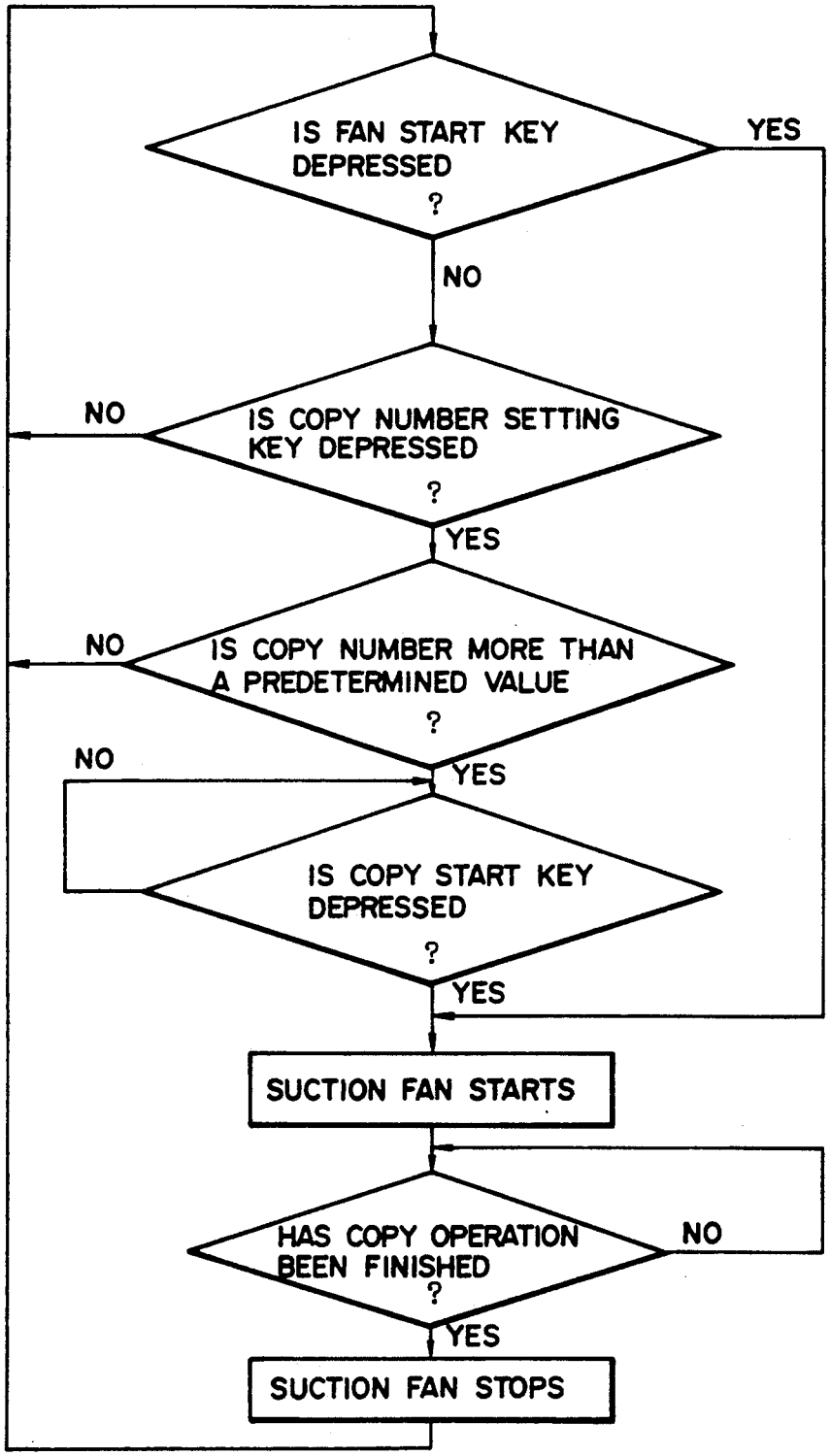
FIG. 6 is a flow chart of the control operation in a dry-type image formation apparatus according to the present invention.

More specifically, the number of copies at which the users sense an unpleasant odor of ozone is preset in a program of the control system. When a copy number counter counts to the preset number, the suction fan 40 is driven to rotate by the control system because a fan operation key and a copy number key mounted on an operation panel (not shown in FIG. 2) of the copying apparatus are interlocked. FIG. 6 is a flow chart of the copying operation in the above case.

From the viewpoint of sufficient decomposition of ozone, the rotation of the suction fan 40 may be stopped after a lapse of a predetermined period rather than immediately after the completion of the copying operation.

When a large number of copies are continuously made, the suction fan is driven to rotate only at need. Accordingly, this control system is advantageous in energy saving.

The above-mentioned embodiment will now be explained in detail by the following examples.

EXAMPLE 5-1

A liquid developer reservoir 22 of the wet-type electrophotographic copying apparatus as shown in FIG. 2 was supplied with a liquid developer which comprised a carrier liquid of a commercially available methylphenyl silicone, "KF-58" (Trademark), made by Shin-Etsu Polymer Co., Ltd.

Using a commercially available transfer sheet, "Type-6200" (A-4 size), made by Ricoh Company, Ltd., a continuous copy test was performed at a linear velocity of 266 mm/sec and an image fixing temperature of 140°±10° C. under the following control conditions.

First, a number "99" was input by the copy number register keys on the operation panel. The copy-making of 99 sheets was repeated ten times at intervals of five minutes, without operating the suction fan. After the completion of the copy-making, the concentration of ozone was 0.017 ppm.

Next, a number "990" was input, and 990 sheets were continuously subjected to the copy-making, without operating the suction fan. After the completion of the copy-making, the ozone concentration was 0.062 ppm. On the other hand, 990 sheets were continuously subjected to the copy-making, with the suction fan operated. The ozone concentration was 0.002 ppm.

Generally, the odor of ozone is sensed at the ozone concentration of 0.02 ppm to 0.04 ppm, although the sensitivity varies from person to person. It is preferable that presetting of the number of copies and the operation of the suction fan be freely altered by switching the position of the DIP switch.

There are many ways to control the operation of the suction fan by the control system.

Examples of the way to control the operation of the suction fan will now be given as follows:

Control System I

The suction fan in this control system I is rotated for 5 seconds after the continuous copying operation over a period of 1 minute.

Figure 7:
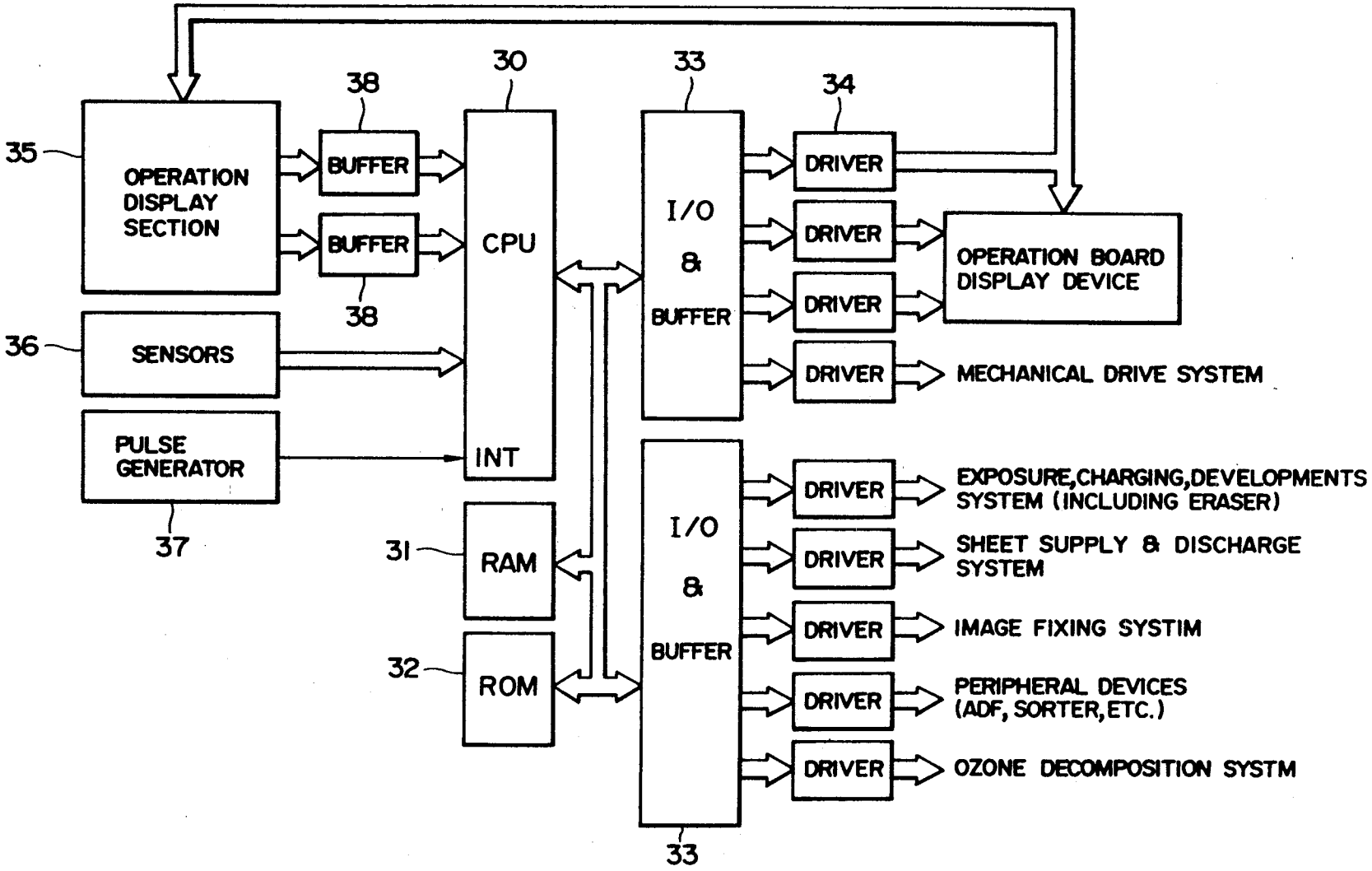
FIG. 7 is a block diagram of a control system which is connected to the mechanism of the wet-type electrophotographic copying apparatus as shown in FIG. 2.

FIG. 7 is a block diagram of the control system I, that is, an electric circuit linked to the mechanism of the wet-type electrophotographic copying apparatus as shown in FIG. 2.

The control system I as shown in FIG. 7 is composed of a central processing unit (CPU) 30, a read-only-memory (ROM) 32, a random access memory (RAM) 31, two input/output port buffers 33, a plurality of drivers 34, an operation display panel unit 35, sensors 36 for detecting the state in the copying apparatus, a pulse generator 37 in synchronization with the photoconductive drum 1 and buffers 38.

The ROM 32, RAM 31 and input/output port buffers 33 are connected to the CPU 30 by address buses, control buses and data buses. The drivers 34 serves to selectively apply a load to each system of the apparatus corresponding to the signals from the input/output port buffers 33. The operation display panel unit 35 includes a print key which starts the copying operation, a ten key, a cassette selection key, an exposure selection key, a magnification selection key, a copy number display and an alarm display. Examples of the sensor for detecting the state in the copying apparatus 36 are an image-fixing temperature sensor and a float sensor for detecting the level of the liquid developer stored in the liquid developer reservoir. The pulse generator 37 generates pulses synchronously with the rotation of the photoconductive drum. The buffers 38 has the function of inputting to the CPU 30 the signals outputted from the operation panel display unit 35.

The on-and-off operation of the motor for the suction fan which works to decompose the ozone generated in the copying apparatus is controlled by the CPU 30 through the input/output port buffer 33 and the driver which is assigned to the control of the motor for the suction fan.

Figure 8:
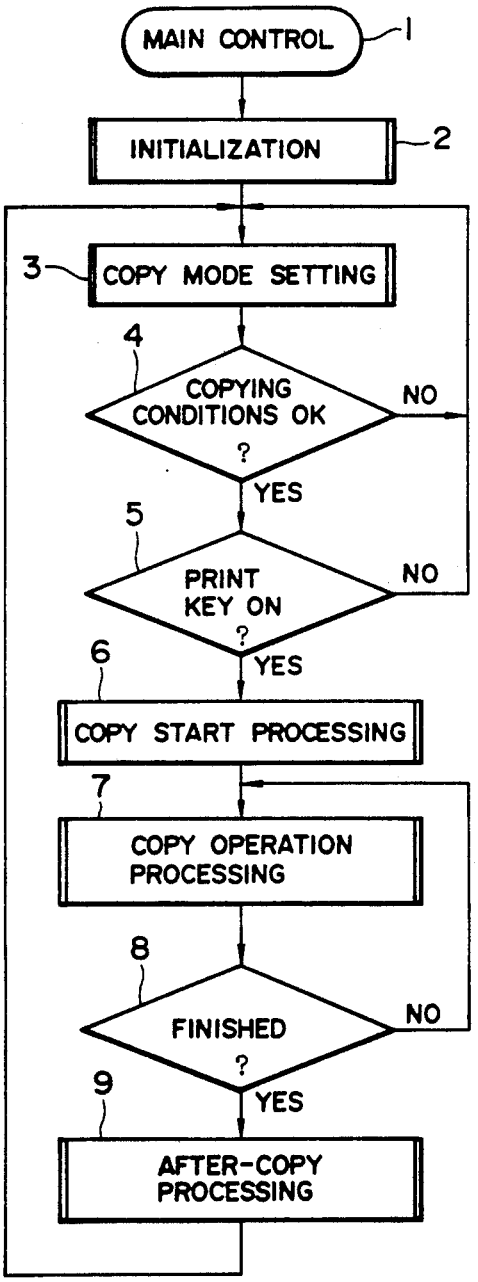
FIGS. 8 to 12 are flow charts of the control operation by a central processing unit (CPU) 30 in the block diagram of FIG. 7.

FIG. 8 is a flow chart of the control operation (main routine) of the CPU 30 in FIG. 7.

When the power is turned on, the CPU 30 starts the main control operation (step 1). The CPU 30 initializes the temperature of a heater of the heat-application roller, and the copy mode such as the number of copies and the magnification (step 2). After the completion of the initialization, the CPU 30 sets the copy mode corresponding to the contents inputted by the operator (step 3). Then, the CPU 30 checks the conditions of the copying operation, for example, whether the heater of the heat-application roller is sufficiently warmed up (step 4). If the conditions of the copying operation are satisfied, the CPU 30 stands ready for the copying operation and waits for the pressing of the print key (step 5).

Figure 9:
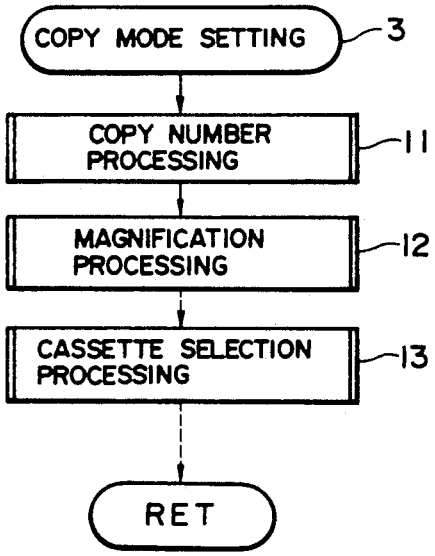

A flow chart of the aforementioned step 3 executed by the CPU 30 is shown in FIG. 9.

In the step 3 of the copy mode setting, the CPU 30 sequentially processes the signals of the number of copies (11), the magnification (12) and the selection of the cassette (13), and other signals in the succeeding subroutines.

Referring to FIG. 8, when the print key is pressed by the operator, the CPU 30 proceeds to the copy-starting processing (step 6).

Figure 10:
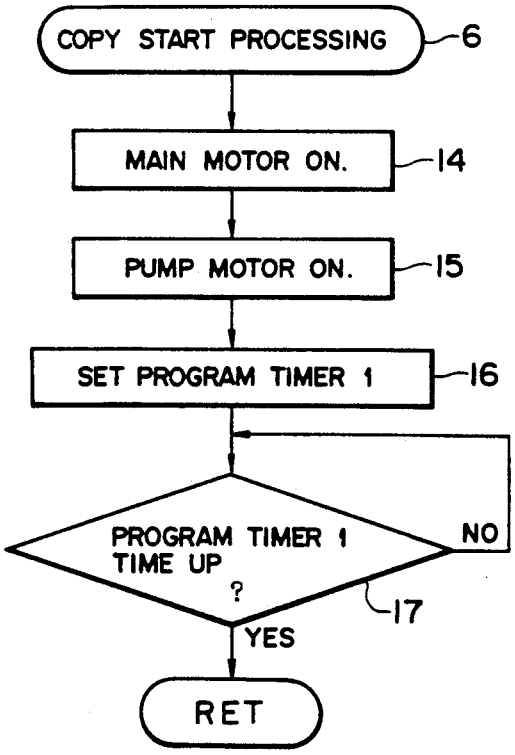

A flow chart of the aforementioned step 6 executed by the CPU 30 is shown in FIG. 10.

In the step 6 of the copy-starting operation, a main motor is turned on (14) to rotate the photoconductive drum, and then a pump motor is turned on (15) to supply a liquid developer stored in a liquid developer reservoir to a development unit and a cleaning unit. Next, the CPU 30 sets to a program timer 1 the required time to sufficiently supply the development unit with the liquid developer since the pump motor has been turned on, and starts the above-mentioned program timer 1 (16). The CPU 30 waits until the time set to the program timer 1 is up (17). When the time is up, the CPU 30 proceeds to the copy-operation processing (step 7) in the flow chart of FIG. 8.

Figure 11:
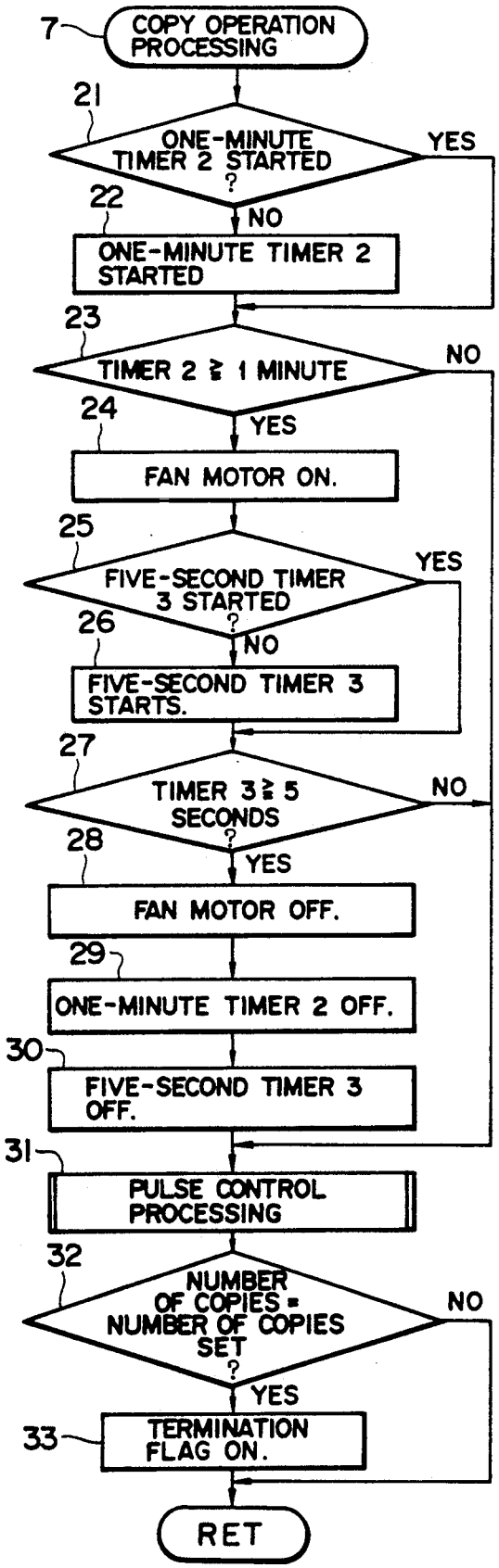

A flow chart of the aforementioned step 7 executed by the CPU 30 is shown in FIG. 11.

In the copy-operation processing (step 7), the CPU 30 first starts a 1-minute program timer 2 (21). Until the program timer 2 is over, the pulse control processing is executed (31) with the motor for the suction fan not operated. In the pulse control processing (31), each part of the image formation process, such as the exposure lamp, electric charger and scanner, is sequentially controlled, and the copy process including the paper supply, paper transportation and image transfer is then controlled, synchronously with the count by the pulse generated from the pulse generator 37 of FIG. 7, which is linked with the photoconductive drum.

Each time a sheet of transfer paper is completely copied, the count of the copy number is increased by one increment and the CPU 30 checks whether the number of copies inputted by the operator has been entirely finished (32). If the required number of copies is not yet finished, the CPU 30 does not turn on a termination flag and escapes from this routine to return to the first stage of the copy operation processing (step 7) again.

The copy operation is thus continued, and when one minute has passed, the expiration of the program timer 2 is detected (23) and the motor for the suction fan in the duct is turned on (24). At the same time, a five-second program timer 3 is set and the program timer 3 starts to count the time (25 and 26). While the program timer 3 is counting the time, the copy operation is similarly continued. When the expiration of the program timer 3 is then detected (27), the motor for the suction fan is turned off (28) and the program timers 2 and 3 are reset (29 and 30). The CPU 30 proceeds to the pulse control processing (31) and once returns to the main routine in FIG. 8. If the required number of copies is not yet finished copying, the CPU 30 proceeds to the copy operation processing (step 7) and starts again the one-minute program timer 2 (21).

In the course of the copying operation, the suction fan is intermittently driven to rotate for 5 seconds every one minute by the above-mentioned control operation of the CPU 30. As a result, ozone generated in the copying apparatus is efficiently decomposed. When the number of copies is completely finished, the copy termination flag is turned on (33), and the CPU 30 proceeds to the after-copy processing (step 9) in the main routine of FIG. 8.

Figure 12:
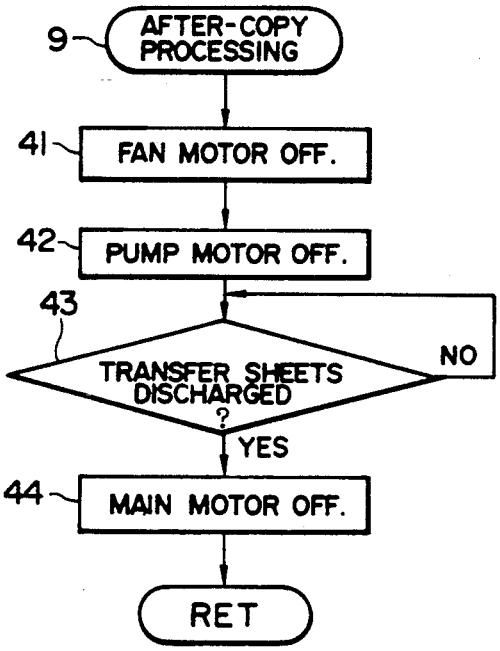

A flow chart of the aforementioned step 9 executed by the CPU 30 is shown in FIG. 12.

In the step 9 of the after-copy processing, the motor for the suction fan is turned off (41) and the pump motor for the liquid developer is stopped (42). Waiting for the residual transfer sheet to be discharged from the copying apparatus (43), the CPU 30 turns off the main motor (44).

Referring to the flow chart of FIG. 8, the termination of the after-copy processing leads to the copy mode setting (step 3), and thereafter, the loop from the step 3 to step 9 is repeated.

Control System II

The suction fan automatically starts to rotate after the continuous copying operation over a period of 1 or 2 minutes.

Figure 13:
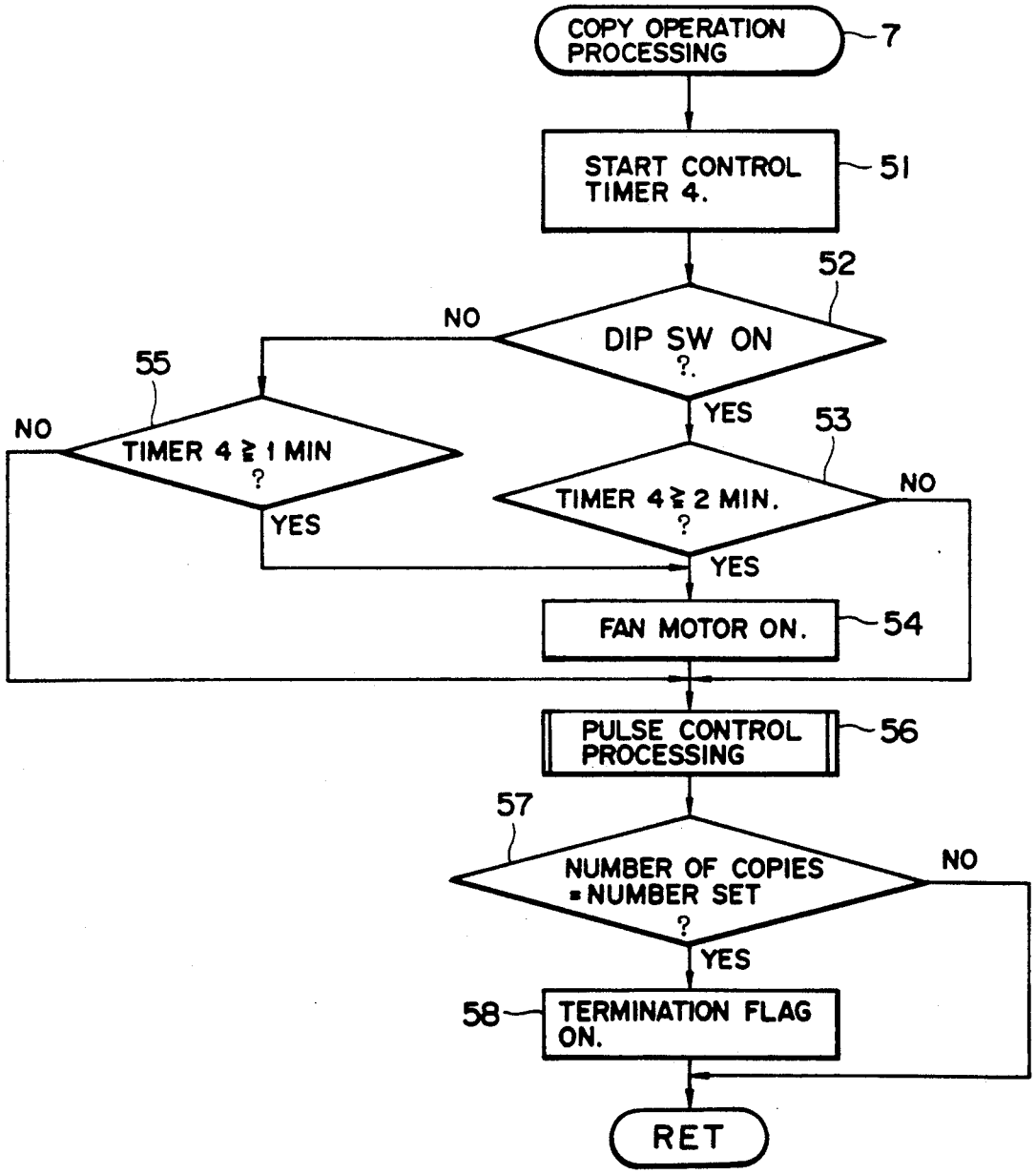
FIG. 13 to 16 are flow charts which show various examples of the copy operation processing in the control operation by CPU 30.

The same control operation as in Control System I is repeated by CPU 30 except that the copy operation processing (step 7) is changed as follows:

A flow chart of the copy operation processing (step 7) in Control System II is shown in FIG. 13.

The CPU 30 first sets a control timer 4 (51), and then checks whether DIP switch is in the "on" or "off" position (52). If the DIP switch is in the "on" position, the CPU 30 waits for the expiration of the control timer 4 for two minutes (53). On the other hand, if the DIP switch is in the "off" position, the CPU 30 waits until the control timer 4 counts the elapsed time of one minute (55). While the CPU 30 waits for the expiration of the control timer 4, the motor for the suction fan is turned off. After a lapse of one or two minutes, the CPU 30 turns on the motor for the suction fan (54).

In Control System II, the motor for the suction fan is turned on and the suction fan is driven to rotate one or two minutes after the copy operation is started. When the continuous copy is finished, the termination flag is turned on (58) and the motor for the suction fan is stopped similarly to the step 41 in the flow chart of FIG. 12.

Depending on the area of a room where the copying apparatus is operated and the ambient circumstances, the time preset to the control timer 4 can freely be altered by switching the position of DIP switch.

Control System III

The suction fan is rotated for 5 seconds after the copy number counter counts to fifty.

Figure 14:
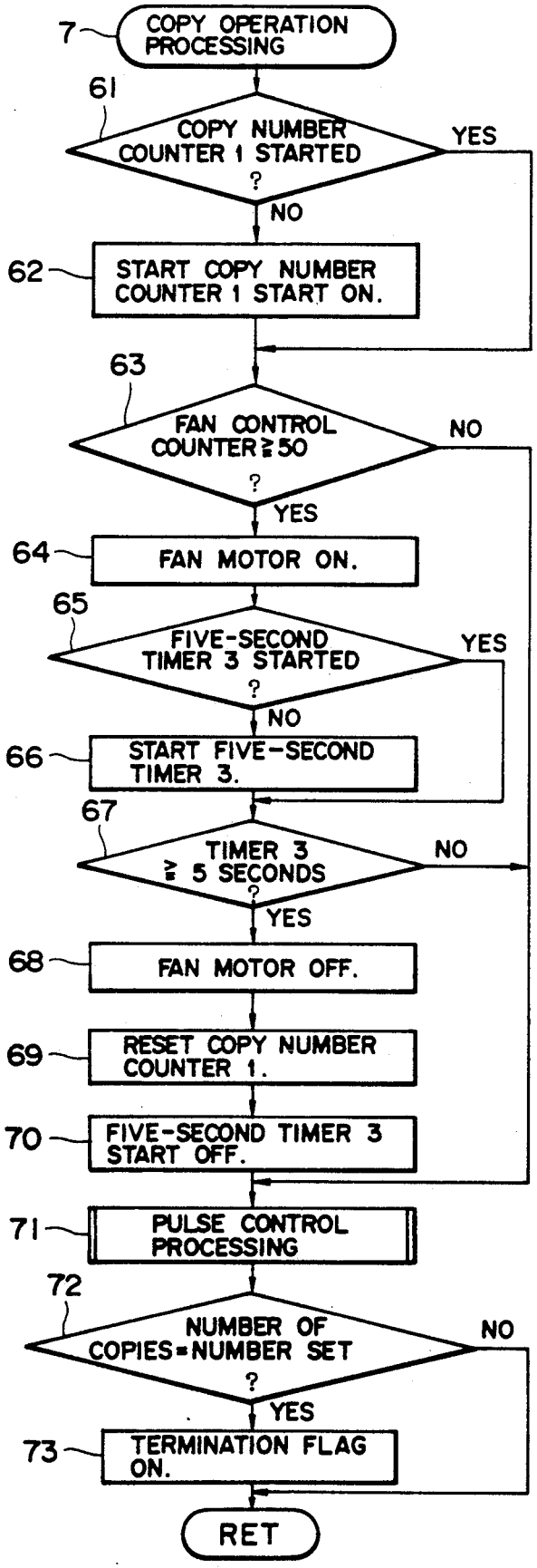

The same control operation as in Control System I is repeated by CPU 30 except that the copy operation processing (step 7) is changed as follows:

A flow chart of the copy operation processing (step 7) in Control System III is shown in FIG. 14.

The CPU 30 first starts a copy number counter 1 (61 and 62). Until the copy number counter counts to fifty, the pulse control processing is executed (71) with the motor for the suction fan not operated. In the pulse control processing (71), each part of the image formation process, such as the exposure lamp, electric charger and scanner is sequentially controlled, and the copy process including the paper supply, paper transportation and image transfer is then controlled, synchronously with the count by the pulse generated from the pulse generator 37 of FIG. 7, which is linked with the photoconductive drum.

The CPU 30 checks whether the number of copies inputted by the operator has been entirely finished (72) every cycle of the copy operation. If the required number of copies is not yet finished, the CPU 30 does not turn on a termination flag and escapes from this routine to return to the first stage of the copy operation processing (step 7) again.

The copy operation is thus continued, and when the copy number counter 1 counts to fifty (63), the motor for the suction fan in the duct is driven to rotate (64). At the same time, a five-second program timer 3 is set and the program timer 3 starts to count the time (65 and 66). While the program timer 3 is counting the time, the copy operation is similarly continued. When the expiration of the program timer 3 is then detected (67), the rotation of the motor for the suction fan is stopped (68) and the copy number counter 1 and the program timer 3 are reset (69 and 70). The CPU 30 proceeds to the pulse control processing (31) and once returns to the main routine in FIG. 8. The values of the copy number counter 1 and the program timer 3 may freely be designated by switching the positions of the respective DIP switches.

Every time the copy number counter counts to fifty, the suction fan is driven to rotate for five seconds by the above-mentioned control operation of the CPU 30. As a result, ozone generated in the copying apparatus is efficiently decomposed. When the number of copies is completely finished, the copy termination flag is turned on (72 and 73), and the CPU 30 proceeds to the after-copy processing (step 9) in the main routine of FIG. 8.

Control System IV

The suction fan automatically starts to rotate after the copy number counter counts to 100 or 50.

Figure 15:
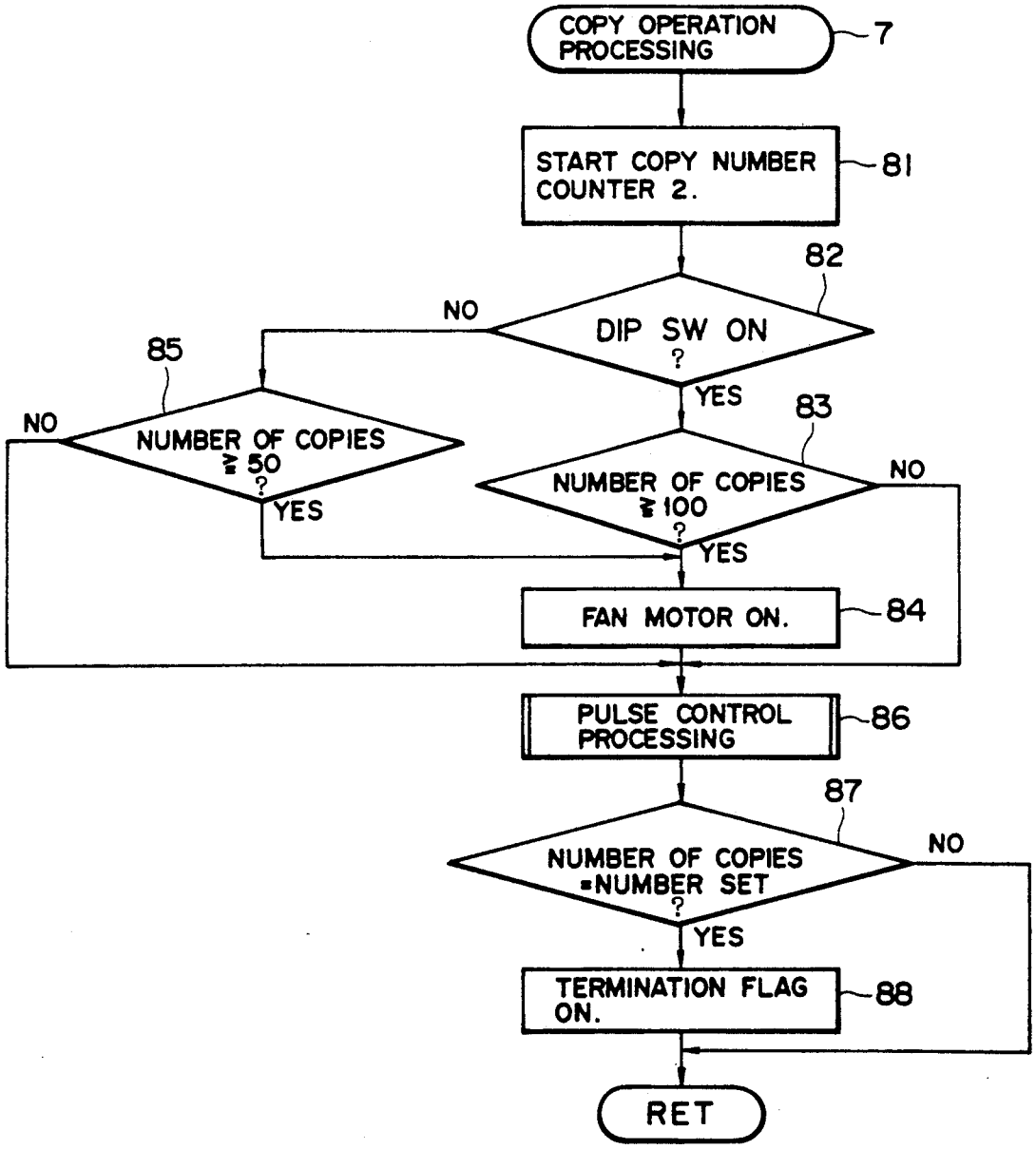

The same control operation as in Control System I is repeated by CPU 30 except that the copy operation processing (step 7) is changed as follows:

A flow chart of the copy operation processing (step 7) in Control System IV is shown in FIG. 15.

The CPU 30 first starts a copy number counter 2 (81). Then, it checks whether DIP switch is in the "on" or "off" position (82) and checks the value inputted in the copy number counter (83 and 85). If the DIP switch is in the "on" position, the pulse control processing is executed (86) with the motor for the suction fan not operated until the copy number counter counts to one hundred. In the pulse control processing (86), each part of the image formation process, such as the exposure lamp, electric charger and scanner is sequentially controlled, and the copy process including the paper supply, paper transportation and image transfer is then controlled, synchronously with the count by the pulse generated from the pulse generator 37 of FIG. 7, which is linked with the photoconductive drum. On the other hand, if the DIP switch is in the "off" position, the pulse control processing is similarly executed (86) with the motor for the suction fan not operated until the copy number counter counts to fifty.

The CPU 30 checks whether the number of copies inputted by the operator has been entirely finished (87) every cycle of the copy operation. If the required number of copies is not yet finished, the CPU 30 does not turn on a termination flag and escapes from this routine to return to the first stage of the copy operation processing (step 7) again.

The copy operation is thus continued, and when the copy number counter 2 counts to one hundred (83) or fifty (85), the motor for the suction fan in the duct is driven to rotate (84). When the number of copies is completely finished, the copy termination flag is turned on (87 and 88), and the CPU 30 proceeds to the after-copy processing (step 9) in the main routine of FIG. 8.

Every time the copy number counter counts to one hundred (or fifty), the suction fan automatically starts to rotate by the above-mentioned control operation of the CPU 30. As a result, ozone generated in the copying apparatus is efficiently decomposed.

Control System V

The suction fan is rotated for 5 seconds after the continuous copying operation over a period of 1 minute, and thereafter, every time the copying operation continues for 40 seconds, the suction fan is rotated for 5 seconds.

When fifty sheets of transfer paper is continuously subjected to the copying operation, the ozone generated in the copying apparatus is practically decomposed by being brought into contact with the mist of a carrier liquid for the liquid developer which scatters around the photoconductive drum. Consequently, the concentration of ozone is as low as 0.003 ppm or less after the completion of the copy-making of fifty sheets.

In Control System V, therefore, the suction fan is caused to rotate for five seconds (first operation) one minute after the copying operation is started. During one minute, about forty sheets can be copied. Thereafter, while the copy operation continues, the suction fan is regularly caused to rotate for five seconds every forty-five seconds. During forty-five seconds, about thirty sheets can be copied.

Figure 17:
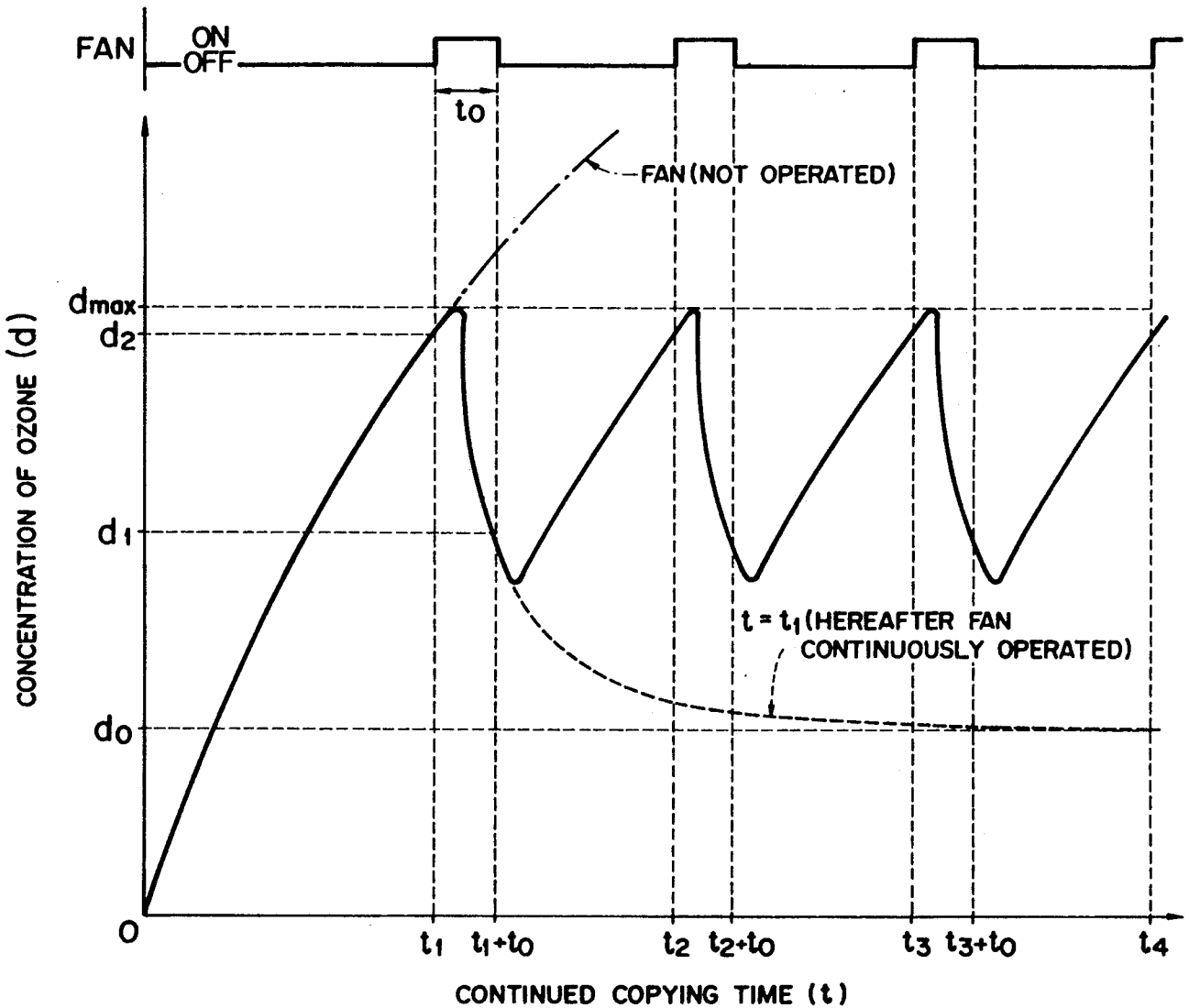
FIG. 17 is a graph showing the relationship between the elapsed time of continuous copying operation and the concentration of ozone generated in the apparatus.

The above-mentioned operating interval of the suction fan will now be supported with reference to FIG. 17.

FIG. 17 is a graph showing the relationship between the elapsed time of the continuous copying operation and the concentration of ozone.

With the lapse of time (from the starting point "0" to "$t_1$"), the concentration of ozone straightly increases from "0" to "$d_2$". When the suction fan is not operated in the copying operation, the concentration of ozone further increases from "$d_2$" as indicated by a chain line.

In the case where the suction fan is driven to rotate when the concentration of ozone reaches the predetermined level "$d_2$", the concentration of ozone slightly increases from "$d_2$" to "$d_{max}$" after starting of the suction fan, and thereafter straightly decreases. While the suction fan is continuously caused to rotate from "$t_1$" to "$t_1+t_0$", the concentration of ozone is lowered to a concentration level "$d_1$".

If only a good timing to first rotate the suction fan can be found with the maximum value of the ozone concentration "$d_{max}$" being sufficiently safe from the viewpoint of hygiene, it is not necessary to rotate the suction fan continuously thereafter. More specifically, after the suction fan starts to rotate at "$t_1$", it may continue to rotate for a period of "$t_0$" until the ozone generated in the copying apparatus is considerably decomposed. Then, the rotation of the suction fan may be stopped when the ozone concentration level lowers to "$d_1$". If the suction fan continues to rotate, the concentration of ozone gradually decreases as indicated by a dotted line.

After the rotation of the suction fan is stopped, the concentration of ozone slightly decreases from "$d_1$" and it increases again. When the level of ozone concentration reaches "$d_2$" again, the suction fan is caused to rotate for a period of "$t_0$'". Thereafter, the operation of the suction fan is repeated until the copying operation is finished.

By actually measuring how long it takes from the starting point or the point "$t_1+t_0$" to the level of the ozone concentration "$d_2$", the operation of the suction fan can be controlled by the control system without constantly detecting the ozone concentration.

As can be seen from the graph in FIG. 17, there is a relationship of $(t_1)>(t_2-t_1)=(t_3-t_2)=(t_4-t_3)$. In this control system, therefore, $(t_1)$ is set to one minute and $(t_2-t_1)$, 45 seconds.

Figure 16:
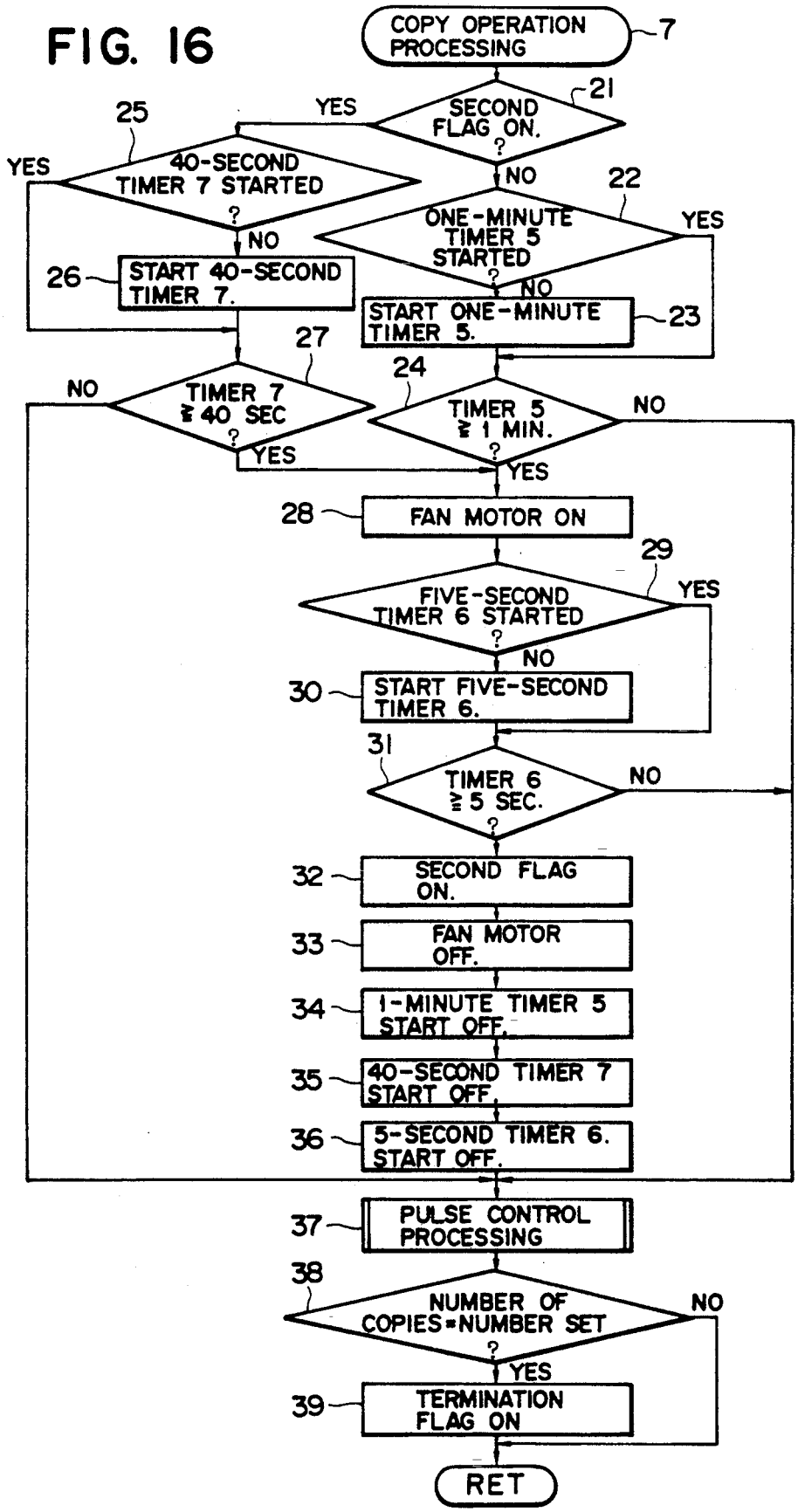

In Control System V, the same control operation as in Control System I is repeated by CPU 30 except that the copy operation processing (step 7) is changed as follows:

A flow chart of the copy operation processing (step 7) in Control System V is shown in FIG. 16.

In the copy-operation processing (step 7), the CPU 30 first starts a one-minute program timer 5 (22 and 23). Until the program timer 5 is over, the pulse control processing is executed (37) with the motor for the suction fan not operated. In the pulse control processing (37), each part of the image formation process, such as the exposure lamp, electric charger and scanner is sequentially controlled, and the copy process including the paper supply, paper transportation and image transfer is then controlled, synchronously with the count by the pulse generated from the pulse generator 37 of FIG. 7, which is linked with the photoconductive drum.

Every cycle of the copy operation, the CPU 30 checks whether the number of copies inputted by the operator has been entirely finished (38). If the required number of copies is not yet finished, the CPU 30 does not turn on a termination flag and escapes from this routine to return to the first stage of the copy operation processing (step 7) again.

The copy operation is thus continued, and when one minute has passed (24), the motor for the suction fan in the duct is driven to rotate (28). At the same time, a five-second program timer 6 is set and the program timer 6 starts to count the time (29 and 30). After five seconds have passed, a second flag is turned on (32) and the rotation of the suction fan is stopped (33). The program timers 5, 7 and 6 are reset (34 , 35 and 36). The CPU 30 proceeds to the pulse control processing (37). If the number of copies does not reach the value inputted by the operator, the CPU 30 returns to the step 21.

At the step 21, since the second flag is turned on (32), a forty-second program timer 7 is started (25 and 26). Until the program timer 7 is over (27), the CPU proceeds to the pulse control processing (37).

Every cycle of the copy operation, the CPU 30 checks whether the number of copies inputted by the operator has been completely finished (38). If the required number of copies is not yet finished, the CPU 30 does not turn on a termination flag and escapes from this routine to return to the first stage of the copy operation processing (step 7) again.

The copy operation is thus continued, and when forty seconds have passed (27), the motor for the suction fan in the duct is driven to rotate (28). At the same time, a five-second program timer 6 is set and the program timer 6 starts to count the time (29 and 30). After five seconds have passed (31), a second flag is turned on (32) and the rotation of the suction fan is stopped (33). The program timers 5, 7 and 6 are reset (34 , 35 and 36). The CPU 30 proceeds to the pulse control processing (37).

In this control system, as previously explained, the copying operation starts and continues for one minute, and then the suction fan is first caused to rotate for five seconds. In the case where the copying operation further continues, the suction fan is caused to rotate for five seconds again forty seconds after the termination of the first rotation. Thereafter, the suction fan is repeatedly caused to rotate for five seconds every forty seconds after the termination of the previous rotation until the copying operation is over. When the copying operation is finished, the copy termination flag is turned on (38) and the CPU 30 proceeds to the after-copy processing (step 9) in FIG. 8.

As previously mentioned, in the image formation apparatus according to the present invention, ozone is intentionally brought into contact with the solvent mist to decompose the ozone. Another control system of the present invention will now be explained by referring to FIG. 5.

Figure 1:
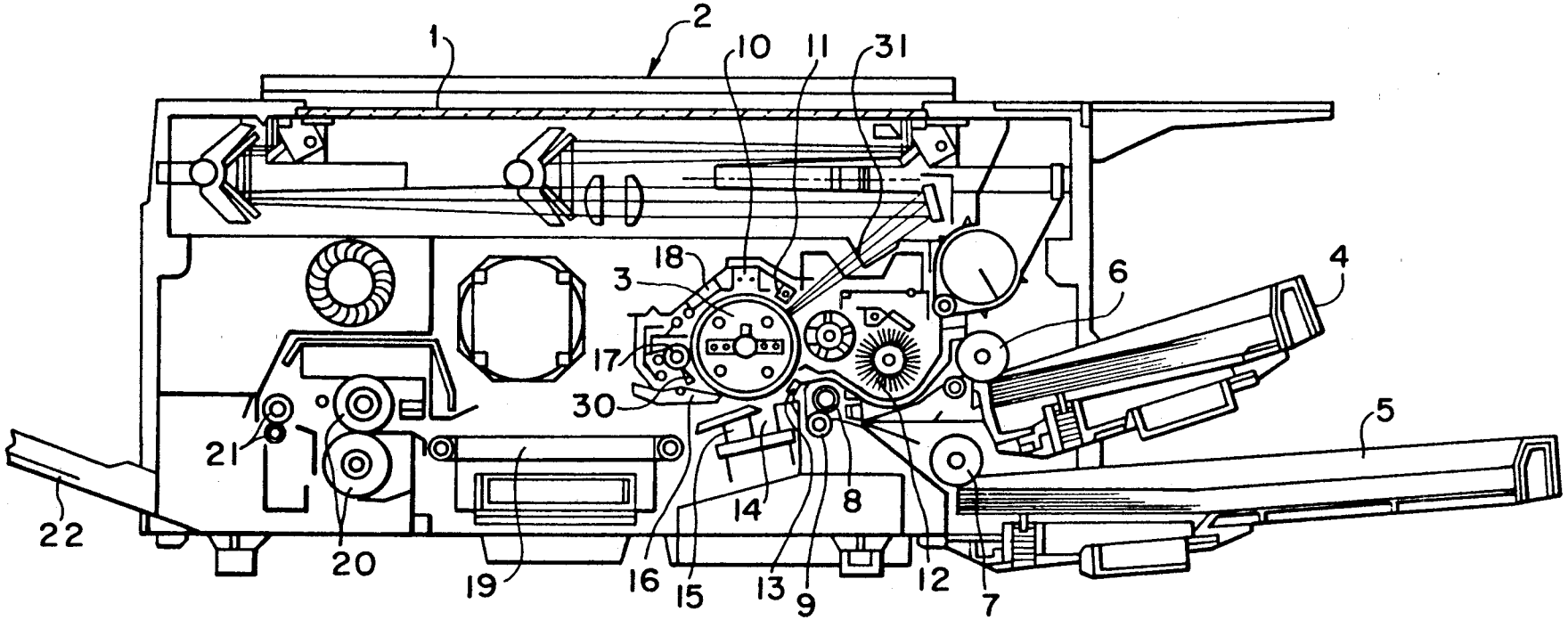
FIG. 1 PRIOR ART
FIG. 1 is a schematic cross-sectional view of a conventional dry-type electrophotographic copying apparatus.
Figure 5:
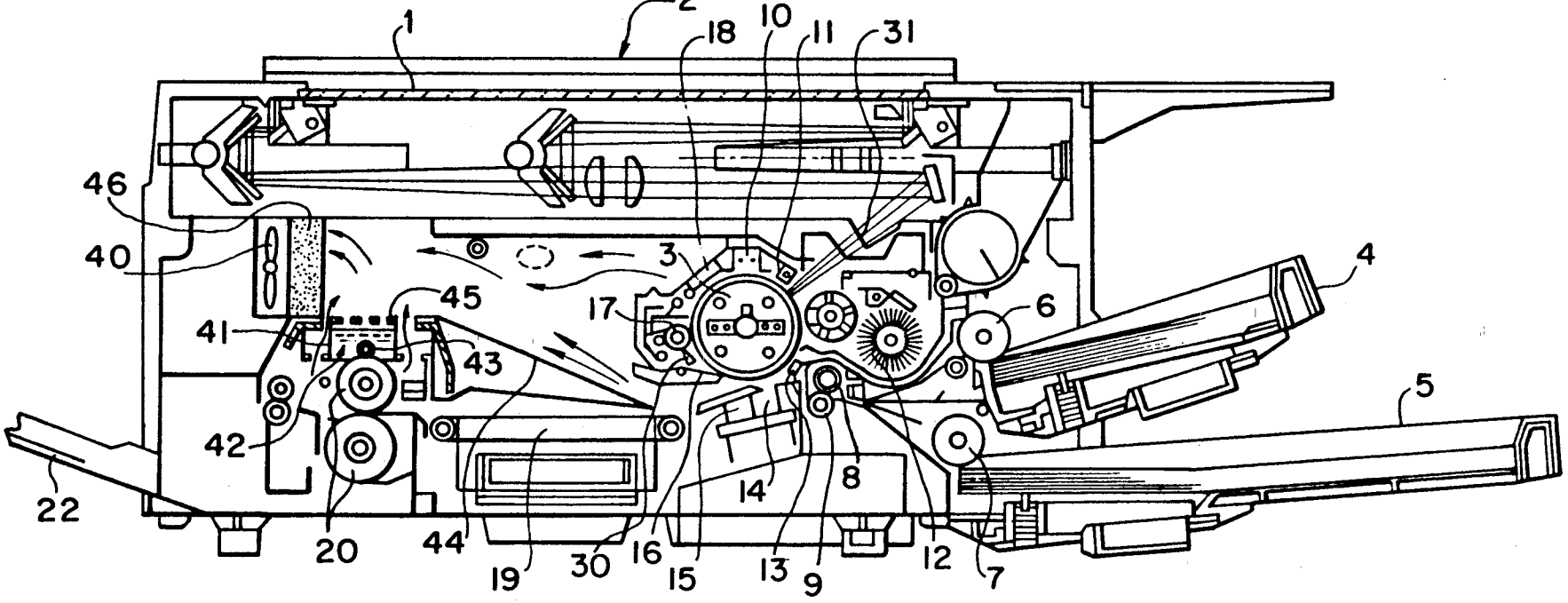
FIG. 5 is a schematic view of a dry-type electrophotographic copying apparatus, one example of the image formation apparatus according to the present invention.

The image forming mechanism employed in the copying apparatus of FIG. 5 is substantially the same as that in the conventional one as shown in FIG. 1.

Ozone is generated from the electric charger 10, the transfer charger 14 and the separation charger 15. In FIG. 5, the ozone is sucked and trapped by a suction fan 40 in the direction of the arrow. The concentration of ozone in the apparatus is detected by an ozone concentration detector (now shown) which is placed at an appropriate position, for example, the position "a" in FIG. 5. Depending on the ozone concentration detected by the ozone concentration detector, a heater 43 in a solvent container 41 is actuated by a solenoid which is controlled by a control system (not shown).

More specifically, when the ozone concentration detected by the ozone concentration detector exceeds the predetermined level, the control system turns on the heater 43 to heat a volatile solvent 42 in the solvent container 41. The solvent mist thus generated from the solvent container 41 is sucked in the direction of the arrow by the aid of the suction fan 40 and comes in contact with the ozone which is also trapped by the suction fan 40, thereby effectively decomposing the ozone. Thereafter, the solvent mist is discharged to the outside together with the decomposed ozone.

As the ozone is decomposed, the ozone concentration decreases in the apparatus. When the ozone concentration falls below the predetermined level, the control system turns off the heater 43 off to stop heating the volatile solvent 42 in the solvent container 41.

In FIG. 5, reference numeral, 44 indicates a guide plate which helps the suction fan 40 to trap ozone. Reference numeral 46 indicates a recovery filter, which has the function of not only trapping the solvent mist in order to effectively bring it into contact with ozone, but also turning the solvent mist into a liquid form to recover the solvent in the solvent container 41.

In the copying apparatus as shown in FIG. 5, it is preferable that the operation of the suction fan 40 be linked with the on-and-off operation of the heater 43 by a control system. Namely, when the heater 43 is turned on, the suction fan 40 is driven to rotate, and on the other hand, when the heater 43 is turned off, the rotation of the suction fan 40 is stopped.

In addition to the above, it is preferable that a shutter 45 be provided at the upper part of the solvent container 41 as shown in FIG. 5. The reason for this is that the solvent 42 in the solvent container 41 evaporates and is wastefully consumed by the remaining heat after the heater 43 is turned off. When the shutter 45 is closed immediately after the heater is turned off, the solvent can be prevented from being wastefully consumed. The open or close operation of the shutter 45 is linked with the on-and-off operation of the heater 43, just like the operation of the suction fan 40. When the heater 43 is turned on, a solenoid of the control system actuated the shutter 45 to open, and when the heater 43 is turned off, the shutter 45 is controlled to be closed.

In the case where the thermal image-fixing process is employed in the image fixing unit, the solvent container 41 is preferably positioned in the vicinity of, particularly above the image fixing unit from the viewpoint of the thermal energy saving.

In addition, it is desirable that the solvent container 41 comprise at least a metal to improve the response to the increase in temperature of the heater 43.

The suction fan 40 may adequately be provided at the paper discharging side of the apparatus in the case where the suction fan 40 also serves to discharge the ozone gas.

The nozzle of the ozone concentration detector may be set at any position where the average concentration of ozone generated in the apparatus can be measured. For instance, the ozone concentration detector may be set at the position "a" in FIG. 5.

Examples of the volatile solvent stored in the solvent container 41 include silicone oils, aliphatic hydrocarbons, aromatic hydrocarbons, lower alcohols, esters, ethers, ketones and halogens. Of these, the silicone oil is preferable because it is non-toxic and has no odor. In addition to the above, the silicone oil can easily be trapped by the filter 46 and thereafter it can readily be turned into droplets.

Furthermore, the silicone oil with a boiling point of 229° C., or a viscosity of 1.5 cs or more is more preferable in terms of a balance of the generation and consumption of the mist. Specific examples of the silicone oil for use in the present invention are a dimethyl silicone, a methylphenyl silicone, and a cyclic polysiloxane.

This control system of the present invention has been explained by referring to the dry-type electrophotographic copying apparatus as shown in FIG. 5. As a matter of course, this control system can be applied to the wet-type one only by using the development unit for the liquid developer. In addition, when this control system is applied to the electrostatic recording apparatus, the latent electrostatic image formation means may be replaced by, for example, a recording head. With respect to the image fixing method, not only the thermal image fixing method by use of a heat-application roller as shown in FIG. 5, but also the thermal image fixing methods by use of a heated plate or flash, and the pressure-application image fixing method can be employed in the present invention.

This control system of the present invention will now be explained in detail by referring to the following examples.

EXAMPLE 6-1

A solvent tank 41 of a dry-type copying apparatus as shown in FIG. 5 was supplied with a commercially available dimethyl silicone, "KF-96" (Trademark), made by Shin-Etsu Polymer Co., Ltd., with a viscosity of 1 cs and a boiling point of less than 299° C. A shutter 45 was not provided at the upper part of the solvent container 41.

A commercially available ozone concentration detector, "DY8410" (Trademark), made by Dylec Co., Ltd., was set 20 cm inside the exhaust vent. In this copying apparatus, a control system is provided, so that the operation of the ozone concentration detector and that of the suction fan 40 were made to link with the on-and-off operation of a heater 43. When the ozone concentration detector detected the ozone concentrations of 0.1 ppm or more, the heater 43 is turned on, which actuated the suction fan 40 to rotate. On the other hand, when the ozone concentration detector detected the ozone concentrations of less than 0.1 ppm, the heater 43 is turned off, which stops the rotation of the suction fan.

Using the above-mentioned copying apparatus, a continuous copy test was carried out for 3 hours in a 30 $m^3$ room without ventilation at the ambient temperature and humidity of 23°±2° C. and 55±5% RH.

After the completion of the copy test, the concentration of ozone was 0.014 ppm, and the odor of ozone was hardly sensed.

The above-mentioned dimethyl silicone with a viscosity of 1 cs generated a considerable amount of mist when the temperature of the heater 43 was in the range of 140° to 150° C. However, the consumption of the dimethyl silicone was also considerable.

COMPARATIVE EXAMPLE 6-1

Using the conventional dry-type electrophotographic copying apparatus as shown in FIG. 1, with the ozone concentration detector set at the same position as in Example 6-1, a copy test was carried out in the same manner as in Example 6-1.

After the completion of the copy test, the ozone concentration was as high as 0.27 ppm.

EXAMPLE 6-2

Using the same dry-type electrophotographic copying apparatus as in Example 6-1, the same copy test as in Example 6-1 was repeated except that a solvent stored in the solvent container 41 was changed to a commercially available dimethyl silicone, "SH-200" (Trademark), made by Toray Silicone Co., Ltd., with a viscosity of 1.5 cs and a boiling point of 229° C. or more.

As a result, the amount of mist which generated from the solvent container 41 was smaller than that in Example 6-1 at the temperature of the heater 43 of 140° to 150° C., but the consumption of the dimethyl silicone used in Example 6-2 was smaller. Therefore, the replenishment cycle of the dimethyl silicone oil was long, and the balance of the generation and consumption of the solvent mist was regarded as preferable.

When the dimethyl silicones with a viscosity of 2 cs, 50 cs and 100 cs (all of them had a boiling point of 229° C. or more) were experimentally used in turn, the balance of the generation and consumption of the solvent mist was rather good in all the cases.

EXAMPLE 6-3

Using the same dry-type electrophotographic copying apparatus as in Example 6-1, the same copy test as in Example 6-1 was repeated except that a shutter 45, which was designed to be opened or closed in accordance with the on-and-off operation of a heater 43 in a solvent container 41, was provided at the upper part of the solvent container 41, as shown in FIG. 5.

As a result, the consumption of the silicone oil was decreased, and ozone was effectively decomposed.

In this control system of the present invention, since the suction fan serving as an ozone trapping means and ozone discharging means, and the solvent container equipped with a built-in heater serving as a solvent mist generation means are intentionally provided in the image formation apparatus, the ozone is efficiently brought into contact with the solvent mist and effectively decomposed.

What is claimed is:

1. An image formation apparatus comprising:

a latent electrostatic image formation means for forming on a latent-electrostatic-image-bearable photoconductive member a latent electrostatic image;

a development means for developing said latent electrostatic image into a visible toner image using a liquid developer;

an ozone decomposing and discharging means for decomposing and discharging ozone generated in said image formation apparatus by mixing said ozone and a solvent mist of said liquid developer generated in said development means; and a solvent mist recovery means for recovering said solvent mist.

2. The image formation apparatus as claimed in claim 1 wherein said solvent mist recovery means is a filter.

3. An image formation apparatus comprising:

a latent electrostatic image formation means for forming on a latent-electrostatic-image bearable photoconductive member a latent electrostatic image;

a development means for developing said latent electrostatic image into a visible toner image with a developer;

an image transfer means for transferring said visible toner image from said photoconductive member to a transfer sheet;

an image-fixing means for fixing said visible toner image to said transfer sheet, comprising an image fixing roller, the surface of which is coated with a release agent;

an ozone decomposing and discharging means for decomposing and discharging ozone generated in said image formation apparatus by mixing a mist of said release agent generated in said image-fixing means and said ozone generated in said image formation apparatus and discharging said ozone;

solvent mist generation means for generating a solvent mist, said solvent mist generation means comprising a solvent reservoir, from which said solvent mist is caused to evaporate; and an ozone concentration detection means for detecting the concentration of ozone generated in said image formation apparatus, the operation of said solvent mist generation means being controlled in accordance with the concentration of ozone detected by said ozone concentration detection means.

4. An image formation apparatus comprising:

a latent electrostatic image formation means for forming on a latent-electrostatic-image-bearable photoconductive member a latent electrostatic image;

a development means for developing said latent electrostatic image into a visible toner image with a developer;

an image transfer means for transferring said visible toner image from said photoconductive member to a transfer sheet;

an image-fixing means for fixing said visible toner image to said transfer sheet, comprising an image fixing roller;

a solvent mist generation means for generating a solvent mist, which comprises a solvent reservoir equipped with a built-in heater, from which said solvent mist is caused to evaporate; and an ozone decomposing means for trapping and decomposing ozone generated in said image formation apparatus by mixing said ozone and said solvent mist.

5. The image formation apparatus as claimed in claim 4, further comprising an ozone concentration detection means for detecting the concentration of ozone generated in said image formation apparatus.

6. The image formation apparatus as claimed in claim 4, further comprising an ozone concentration detection means for detecting the concentration of ozone generated in said image formation apparatus, and wherein said built-in heater is turned ON or OFF, in accordance with the concentration of ozone detected by said ozone concentration detection means.

7. The image formation apparatus as claimed in claim 4, wherein said solvent mist generation means further comprises a shutter for controlling the amount of said solvent mist from said solvent reservoir.

8. The image formation apparatus as claimed in claim 7, further comprising an ozone concentration detection means for detecting the concentration of ozone generated in said image formation apparatus, and wherein said built-in heater is turned ON or OFF, in accordance with the concentration of ozone detected by said ozone concentration detection means and said shutter is opened or closed in collaboration with ON or OFF of said built-in heater.

9. The image formation apparatus as claimed in claim 4, further comprising an ozone concentration detection means for detecting the concentration of ozone generated in said image formation apparatus and a suction fan for discharging said solvent mist outside said image formation apparatus.

10. The image formation apparatus as claimed in claim 9, wherein said suction fan is operated in accordance with the concentration of ozone detected by said ozone detection means.

11. An image formation apparatus comprising:

a latent electrostatic image formation means for forming on a latent-electrostatic-image-bearable photoconductive member a latent electrostatic image;

a development means using a liquid developer for developing said latent electrostatic image into a visible toner image with a liquid developer;

an image transfer means for transferring said visible toner image from said photoconductive member to a transfer sheet;

an image-fixing means for fixing said visible toner image to said transfer sheet, comprising an image fixing roller;

a solvent mist generation means for generating a solvent mist;

an ozone decomposing means for trapping and decomposing ozone generated in said image formation apparatus by mixing said ozone and said solvent mist; and a means for counting the number of copies made, said ozone decomposing means being operated in accordance with the number of copies counted.

12. An image formation apparatus comprising:

a latent electrostatic image formation means for forming on a latent-electrostatic-image-bearable photoconductive member a latent electrostatic image;

a development means using a liquid developer for developing said latent electrostatic image into a visible toner image with a liquid developer;

an image transfer means for transferring said visible toner image from said photoconductive member to a transfer sheet;

an image-fixing means for fixing said visible toner image to said transfer sheet, comprising an image fixing roller;

a solvent mist generation means for generating a solvent mist;

an ozone decomposing means for trapping and decomposing ozone generated in said image formation apparatus by mixing said ozone and said solvent mist; and a means for measuring the timer period of continuous copy making, said ozone decomposing means being operated in accordance with the measured copy making time period.

13. The image formation apparatus as claimed in claim 12, wherein said ozone and solvent mist trapping means is operated for different periods including at least three different periods, with the first period being different from the second period, and the second period being different from the third period.

14. An image formation apparatus comprising:

a latent electrostatic image formation means for forming on a latent-electrostatic-image bearable photoconductive member a latent electrostatic image;

a development means for developing said latent electrostatic image into a visible toner image with a developer;

an image transfer means for transferring said visible toner image from said photoconductive member to a transfer sheet;

an image-fixing means for fixing said visible toner image to said transfer sheet, comprising an image fixing roller, the surface of which is coated with a release agent;

an ozone decomposing and discharging means for decomposing and discharging ozone generated in said image formation apparatus by mixing a mist of said release agent generated in said image-fixing means and said ozone generated in said image formation apparatus and discharging said ozone; and a mist recovery means for recovering said mist.

15. The image formation apparatus as claimed in claim 14, wherein said mist recovery means is a filter.

16. An image formation apparatus for implementing at least an image formation process of forming a latent electrostatic image on a photoconductor and developing said latent electrostatic image to a visible image, using a liquid at least in one step of said process, comprising:

an ozone decomposing and discharging means for decomposing ozone generated in said image formation apparatus and discharging the same therefrom by mixing a mist of said liquid and said ozone; and a mist recovery means for recovering said mist.

17. The image formation apparatus as claimed in claim 16, wherein said mist recovery means is a filter.

* * * * *